US010522100B2

(12) United States Patent
Jeong et al.

(10) Patent No.: US 10,522,100 B2
(45) Date of Patent: Dec. 31, 2019

(54) METHOD OF DRIVING A DISPLAY PANEL AND DISPLAY APPARATUS PERFORMING THE SAME

(71) Applicant: SAMSUNG DISPLAY CO., LTD., Yongin, Gyeonggi-Do (KR)

(72) Inventors: Jae-Won Jeong, Seoul (KR); Kwan-Young Oh, Hwaseong-si (KR); Ga-Na Kim, Icheon-si (KR); Gyeong-Ub Moon, Cheonan-si (KR); Po-Yun Park, Seoul (KR); Ji-Woong Jeong, Yongin-si (KR); Kyung-Uk Choi, Gunpo-si (KR); Sang-Ho Park, Seongnam-si (KR)

(73) Assignee: SAMSUNG DISPLAY CO., LTD., Yongin, Gyeonggi-Do (KR)

( * ) Notice: Subject to any disclaimer, the term of this patent is extended or adjusted under 35 U.S.C. 154(b) by 711 days.

(21) Appl. No.: 14/788,037

(22) Filed: Jun. 30, 2015

(65) Prior Publication Data

US 2016/0049123 A1 Feb. 18, 2016

(30) Foreign Application Priority Data

Aug. 12, 2014 (KR) ..... 10-2014-0104493

(51) Int. Cl.
*G09G 3/36* (2006.01)

(52) U.S. Cl.
CPC ..... *G09G 3/3607* (2013.01); *G09G 3/3614* (2013.01); *G09G 2300/0443* (2013.01); (Continued)

(58) Field of Classification Search
CPC ..... G09G 3/3607; G09G 3/3696; G09G 5/02; G09G 5/026; G09G 2300/0443; G09G 2300/0452; G09G 2320/0242
See application file for complete search history.

(56) References Cited

U.S. PATENT DOCUMENTS

2003/0052904 A1* 3/2003 Gu ..... G09G 3/2014 345/691
2011/0063338 A1* 3/2011 Sedzin ..... G02F 1/133603 345/690

(Continued)

FOREIGN PATENT DOCUMENTS

KR 1020030005748 1/2003
KR 1020080016048 2/2008

(Continued)

*Primary Examiner* — William Boddie
*Assistant Examiner* — Jeffrey A Parker
(74) *Attorney, Agent, or Firm* — F. Chau & Associates, LLC

(57) ABSTRACT

A method of driving a display panel includes compensating first pixel data corresponding to a first pixel of a plurality of pixels in the display panel based on at least one of a first decision, a second decision, or a third decision and generating a first data voltage corresponding to the compensated first pixel data. The first data voltage is applied to the first pixel through a data line. The first decision includes determining, based on a position of the first pixel, whether compensation for the first pixel data is required. The second decision includes determining, based on previous subpixel data and present subpixel data for the first pixel, whether the compensation for the first pixel data is required. The third decision includes determining whether the first pixel data complies with a compensation avoidance condition.

19 Claims, 12 Drawing Sheets

(52) U.S. Cl.
CPC . *G09G 2300/0452* (2013.01); *G09G 2340/00* (2013.01); *G09G 2340/16* (2013.01); *G09G 2360/16* (2013.01)

(56) References Cited

U.S. PATENT DOCUMENTS

2013/0169619 A1* 7/2013 Jeong ..... G09G 5/001
345/212
2015/0279298 A1* 10/2015 Lin ..... G09G 3/3648
345/100

FOREIGN PATENT DOCUMENTS

KR 1020080092709 10/2008
KR 1020120114878 10/2012
KR 1020130079950 7/2013

* cited by examiner

METHOD OF DRIVING A DISPLAY PANEL AND DISPLAY APPARATUS PERFORMING THE SAME

CROSS-REFERENCE TO RELATED APPLICATION

This application claims priority under 35 U.S.C. § 119 to Korean Patent Application No. 10-2014-0104493, filed on Aug. 12, 2014, in the Korean Intellectual Property Office (KIPO), the disclosure of which is incorporated by reference herein in its entirety.

TECHNICAL FIELD

The present inventive concept relates to a display apparatus, and more particularly to a method of driving a display panel and a display apparatus performing the method.

DISCUSSION OF THE RELATED ART

As display resolution of a liquid crystal display (LCD) apparatus increases, the number of horizontal rows may increase and thus, a charging duration of a subpixel may be reduced. Thus, a precharge driving scheme has been developed to secure the charging duration of the subpixel. In the precharge driving scheme, a precharge voltage may be charged to the subpixel before a data voltage is charged to the subpixel. The precharge driving scheme may result in a display defect. Accordingly, a difference of luminance between subpixels may occur in a horizontal direction or a vertical direction due to the difference between a precharge voltage and a charging voltage, and thus, a horizontal or a vertical spot line may appear on a display panel.

SUMMARY

According to an exemplary embodiment of the present inventive concept, a method of driving a display panel is provided. The method includes compensating first pixel data corresponding to a first pixel of a plurality of pixel in the display panel based on at least one of a first decision, a second decision, or a third decision and generating a first data voltage corresponding to the compensated first pixel data. The first data voltage is applied to the first pixel through a data line. The first decision includes determining, based on a position of the first pixel, whether compensation for the first pixel data is required. The second decision includes determining, based on previous subpixel data and present subpixel data for the first pixel, whether the compensation for the first pixel data is required. The third decision includes determining whether the first pixel data complies with a compensation avoidance condition.

The third decision may further include determining a first color displayed through the first pixel based on the first pixel data. The third decision may be performed to maintain the first pixel data when the first pixel displays one of three primary colors. The third decision may be performed to compensate the first pixel data when the first pixel displays a color other than the three primary colors.

The first pixel may include a first subpixel, a second subpixel, and a third subpixel. The first subpixel may operate based on first subpixel data. The second subpixel may operate based on the present subpixel data. The third subpixel may operate based on the previous subpixel data.

Determining the first color may include comparing the previous subpixel data with first threshold data, comparing the first subpixel data with the first threshold data, determining that the first pixel displays one of the three primary colors when a value of the previous subpixel data is smaller than a value of the first threshold data and when a value of the first subpixel data is smaller than the value of the first threshold data, and determining that the first pixel displays the color other than the three primary colors when the value of the previous subpixel data is equal to or greater than the value of the first threshold data or when the value of the first subpixel data is equal to or greater than the value of the first threshold data.

Compensating the first pixel data may further include adding a value of compensation data to a value of the present subpixel data when all of the first decision, the second decision, or the third decision indicate that the compensation for the first pixel data is required and maintaining the present subpixel data when at least one of the first decision, the second decision, or the third decision indicates that to the compensation for the first pixel data is not required.

Compensating first pixel data may further include determining a second color displayed through a second pixel adjacent to the first pixel after a first color displayed displayed through the first pixel is determined, and comparing a first maximum grayscale with a second maximum grayscale. The first maximum grayscale may be the greatest one of first grayscales of the first color. The second maximum grayscale may be the greatest one of second grayscales of the second color. The compensating first pixel data may further include comparing each of grayscales other than the first maximum grayscale among the first grayscales with a reference grayscale, decreasing the value of the compensation data when the second pixel displays one of three primary colors, and when the first maximum grayscale is substantially the same as the second maximum grayscale, and when each of the grayscales other than the first maximum grayscale among the first grayscales is smaller than the reference grayscale, and maintaining the value of the compensation data when the second pixel displays a color other than the three primary colors, or when the first maximum grayscale is different from the second maximum grayscale, or when each of the grayscales other than the first maximum grayscale among the first grayscales is equal to or greater than the reference grayscale. The first pixel and the second pixel may be disposed in a first horizontal line of the display panel.

The second decision may further include comparing the previous subpixel data with first threshold data and comparing the present subpixel data with second threshold data. The second decision may be performed to compensate the first pixel data when a value of the previous subpixel data is smaller than a value of the first threshold data and when a value of the present subpixel data is greater than a value of the second threshold data. The second decision may be performed to maintain the first pixel data when the value of the previous subpixel data is equal to or greater than the value of the first threshold data or when the value of the present subpixel data is equal to or smaller than the value of the second threshold data.

The second decision may further include comparing first difference data with first threshold data. The first difference data may correspond to a difference between the present subpixel data and the previous subpixel data. The second decision may be performed to compensate the first pixel data when a value of the first difference data is greater than a value of the first threshold data. The second decision may be performed to maintain the first pixel data when the value of the first difference data is equal to or smaller than the value of the first threshold data.

The second decision may further include comparing the previous subpixel data with first threshold data, comparing the present subpixel data with second threshold data, and comparing first difference data with third threshold data. The first difference data may correspond to a difference between the present subpixel data and the previous subpixel data. The second decision may be performed to compensate the first pixel data when a value of the previous subpixel data is smaller than a value of the first threshold data, and when a value of the present subpixel data is greater than a value of the second threshold data, and when a value of the first difference data is greater than a value of the third threshold data. The second decision may be performed to maintain the first pixel data when the value of the previous subpixel data is equal to or greater than the value of the first threshold data, or when the value of the present subpixel data is equal to or smaller than the value of the second threshold data, or when the value of the first difference data is equal to or smaller than the value of the third threshold data.

According to an exemplary embodiment of the present inventive concept, a display apparatus is provided. The display apparatus includes a display panel, a gate driver, a data driver, and a timing controller. The display panel includes a first pixel connected to a gate line and a data line. The gate driver is configured to apply a gate signal to the gate line. The gate signal has an active period corresponding to at least two successive horizontal periods. The data driver is configured to generate a first data voltage corresponding to first pixel data for the first pixel. The first data voltage is applied to the data line. The timing controller is configured to control the gate driver and the data driver, to perform a first decision, a second decision, or a third decision, and to compensate the first pixel data based on the first decision, the second decision, or the third decision. The first decision includes determining, based on a position of the first pixel in the display panel, whether the compensation for the first pixel data is required. The second decision includes determining, based on previous subpixel data and present subpixel data for the first pixel, whether the compensation for the first pixel data is required. The third decision includes determining whether the first pixel data complies with a compensation avoidance condition.

The timing controller may include a data compensation unit and a control signal generation unit. The data compensation unit may be configured to perform the at least one of the first decision, the second decision, or the third decision, and to compensate the first pixel data based on the at least one of the first decision, the second decision, or the third decision. The control signal generation unit may be configured to generate a first control signal for the gate driver and a second control signal for the data driver based on an input control signal.

The data compensation unit may be configured to perform the third decision to maintain the first pixel data when the first pixel displays one of three primary colors, or the data compensation unit may be configured to perform the third decision to compensate the first pixel data when the first pixel displays color other than the three primary colors.

The first pixel may include a first subpixel, a second subpixel, and a third subpixel. The first subpixel may be configured to operate based on first subpixel data. The second subpixel may be configured to operate based on the present subpixel data. The third subpixel may be configured to operate based on the previous subpixel data. The data compensation unit may determine that the first pixel displays one of the three primary colors when a value of the previous subpixel data is smaller than a value of first threshold data and when a value of the first subpixel data is smaller than the value of the first threshold data.

The data compensation unit may add a value of compensation data to a value of the present subpixel data when all of the first decision, the second decision, or the third decision result indicate that the compensation for the first pixel data is required.

The data compensation unit may change the compensation data.

The data compensation unit may reduce the value of the compensation data when a second pixel adjacent to the first pixel displays one of three primary colors, and when a greatest first grayscale among first grayscales of a first color displayed through the first pixel is substantially the same as a greatest second grayscales of second grayscales of a second color displayed through the second pixel, and when each of first grayscales other than the greatest first grayscale among the first grayscales is smaller than a reference grayscale. The first pixel and the second pixel may be disposed in a first horizontal line According to an exemplary embodiment of the present inventive concept, a method of driving a display panel is provided. The method includes analyzing a plurality of pixel data for a plurality of pixels disposed in a first horizontal line of the display panel, selecting one of a first compensation method or a second compensation method, based on the analyzation result, for compensation on the plurality of pixel data. The first compensation method includes a first decision, based on a position of a first pixel in the display panel, as to whether compensation for first pixel data corresponding to the first pixel among the plurality of pixel data is required, performing a second decision, based on previous subpixel data and present subpixel data for the first pixel, as to whether the compensation for the first pixel data is required, performing a third decision as to whether the first pixel data complies with a compensation avoidance condition, and compensating the first pixel data based on at least one of the first decision, the second decision, or the third decision. The second compensation method includes performing the first decision and the second decision, and compensating the first pixel data based on at least one of the first decision or the second decision.

Analyzing the plurality of pixel data may include determining a plurality of colors displayed through the plurality of pixels based on the plurality of pixel data. The analyzation result may be generated to select the first compensation method for the compensation on the plurality of pixel data when the plurality of pixels display only at least one color selected from three primary colors or only at least one color selected from three mixed colors including cyan, magenta, and yellow colors. The analyzation result may be generated to select the second compensation method for the compensation on the plurality of pixel data when the plurality of pixels display both of the at least one color selected from the three primary colors and the at least one color selected from the three mixed colors.

Analyzing the plurality of pixel data may include determining a plurality of colors displayed through the plurality of pixels based on the plurality of pixel data and comparing a number of N pixels (where N is a natural number equal to or greater than two) among the plurality of pixels with a reference number. The N pixels may be successively disposed in the first horizontal line and may display only at least one color selected from three primary colors. The analyzation result may be generated to select the first compensation method for compensation on N pixel data for the N pixels when the number of the N pixels is smaller than or equal to the reference number. The analyzation result may be generated to select the second compensation method for the compensation on the N pixel data for the N pixels when the number of the N pixels is greater than the reference number.

According to an exemplary embodiment of the present inventive concept, a display apparatus is provided. The display apparatus includes a display panel and a data compensation unit. The display panel includes a plurality of pixels. The data compensation unit is configured to compensate first pixel data corresponding to a first pixel of the plurality of pixels. The first pixel includes a first subpixel, a second subpixel, and a third subpixel. The first subpixel and the second subpixel are connected to a first data line of the display panel. The first subpixel is configured to operate based on first subpixel data for the first pixel during a first period and a second period subsequent to the first period. The second subpixel is configured to operate based on second subpixel data for the first pixel during the second period and a third period subsequent to the second period. The compensating of the first pixel data includes changing a value of the second subpixel data for the first pixel based on at least a comparison result between the first subpixel data and the second subpixel data.

BRIEF DESCRIPTION OF THE DRAWINGS

Illustrative, non-limiting exemplary embodiments of the present inventive concept will be more clearly understood from the following detailed description taken in conjunction with the accompanying drawings.

DETAILED DESCRIPTION OF THE EMBODIMENTS

Figure 1:
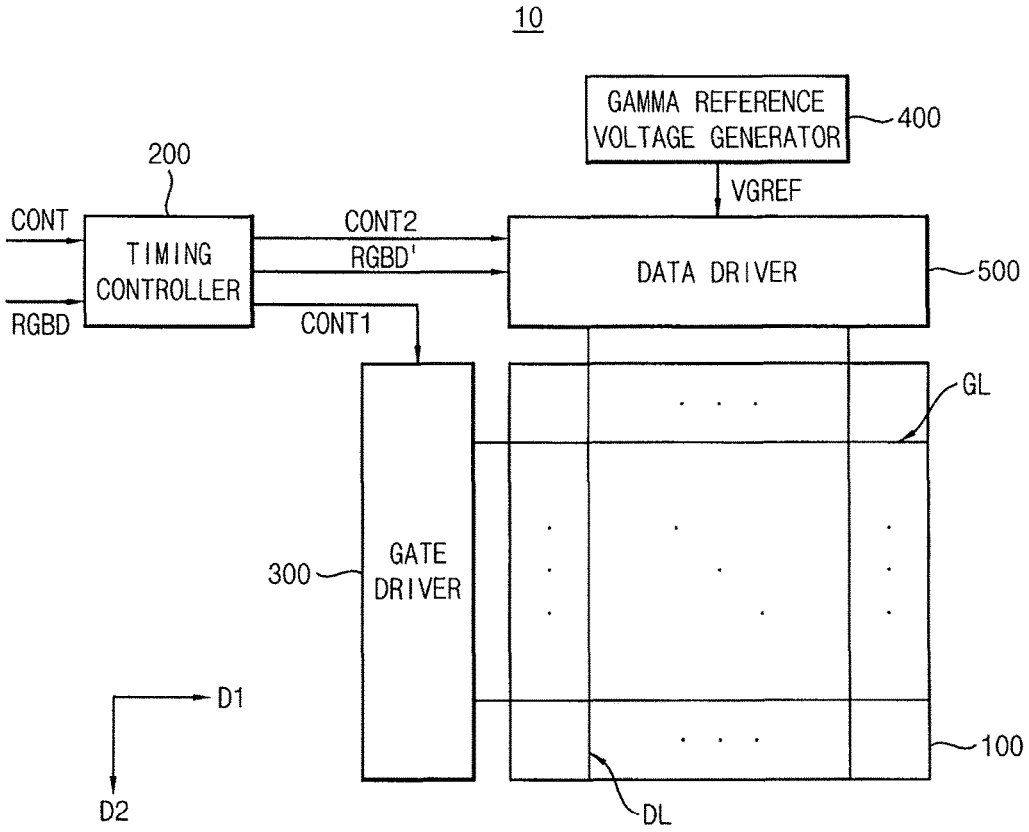
FIG. 1 is a block diagram of a display apparatus according to an exemplary embodiment of the present inventive concept.

Various exemplary embodiments of the present inventive concept will be described more fully with reference to the accompanying drawings, in which exemplary embodiments thereof are shown. This present inventive concept may, however, be embodied in many different forms and should not be construed as limited to the embodiments set forth herein. Like reference numerals may refer to like elements throughout the specification and drawings.

It will be understood that, although the terms first, second, etc. may be used herein to describe various elements, these elements should not be limited by these terms. These terms are used to distinguish one element from another. For example, a first element could be termed a second element, and, similarly, a second element could be termed a first element, without departing from the scope of the present inventive concept. As used herein, the term "and/or" includes any and all combinations of one or more of the associated listed items.

As used herein, the singular forms "a," "an" and "the" are intended to include the plural forms as well, unless the context clearly indicates otherwise.

FIG. 1 is a block diagram of a display apparatus according to an exemplary embodiment of the present inventive concept.

Referring to FIG. 1, a display apparatus 10 includes a display panel 100, a timing controller 200, a gate driver 300, a gamma reference voltage generator 400, and a data driver 500.

The display panel 100 includes a plurality of gate lines GL, a plurality of data lines DL, and a plurality of pixels (not illustrated) connected to the gate lines GL and the data lines DL.

The gate lines GL extend in a first direction D1, and the data lines DL extend in a second direction D2 substantially perpendicular to the first direction D1. The plurality of pixels may be arranged in a matrix form. Each of the plurality of pixels may include at least two subpixels.

Each subpixel in each of the plurality of pixels may include a switching element (not illustrated), a liquid crystal capacitor (not illustrated), and a storage capacitor (not illustrated). The liquid crystal capacitor and the storage capacitor may be electrically connected to the switching element. The switching element may be a thin film transistor. The liquid crystal capacitor may include a first electrode connected to a pixel electrode and a second electrode connected to a common electrode. A data voltage may be applied to the first electrode of the liquid crystal capacitor. A common voltage may be applied to the second electrode of the liquid crystal capacitor. The storage capacitor may include a first electrode connected to the pixel electrode and a second electrode connected to a storage electrode. The data voltage may be applied to the first electrode of the storage capacitor. A storage voltage may be applied to the second electrode of the storage capacitor. The storage voltage may be substantially equal to the common voltage.

Each subpixel may have a rectangular shape. Each subpixel may have a relatively short side in the first direction D1 and a relatively long side in the second direction D2. The relatively short side of each subpixel may be substantially parallel to the gate lines GL. The relatively long side of each subpixel may be substantially parallel to the data lines DL. Detailed configurations of the pixels and the subpixels will be described below with reference to FIG. 3.

The timing controller 200 receives input image data RGBD and an input control signal CONT from an external device (e.g., a host). The input image data RGBD may include a plurality of input pixel data for the plurality of pixels. Each input pixel data may include red grayscale data R, green grayscale data G, and blue grayscale data B for a respective one of the plurality of pixels. The input control signal CONT may include a master clock signal, a data enable signal, a vertical synchronization signal, a horizontal synchronization signal, etc.

The timing controller 200 generates output image data RGBD', a first control signal CONT1, and a second control signal CONT2 based on the input image data RGBD and the input control signal CONT.

For example, the timing controller 200 may generate the first control signal CONT1 based on the input control signal CONT. The first control signal CONT1 may be provided to the gate driver 300, and a driving timing of the gate driver 300 may be controlled based on the first control signal CONT1. The first control signal CONT1 may include a vertical start signal, a gate clock signal, etc. The timing controller 200 may generate the second control signal CONT2 based on the input control signal CONT. The second control signal CONT2 may be provided to the data driver 500, and a driving timing of the data driver 500 may be controlled based on the second control signal CONT2. The second control signal CONT2 may include a horizontal start signal, a load signal, etc.

The timing controller 200 may generate the output image data RGBD' based on the input image data RGBD. The output image data RGBD' may be provided to the data driver 500. In an exemplary embodiment of the present inventive concept, the output image data RGBD' may be substantially the same as the input image data RGBD. In an exemplary embodiment of the present inventive concept, the output image data RGBD' may be compensated image data that is generated based on the input image data RGBD and compensation data. Similarly to the input image data RGBD, the output image data RGBD' may include a plurality of output pixel data corresponding to the plurality of pixels, respectively. Detailed configurations and operations of the timing controller 200 will be described below with reference to FIG. 2 and FIGS. 5 through 17.

The gate driver 300 receives the first control signal CONT1 from the timing controller 200. The gate driver 300 generates gate signals for driving the gate lines GL in response to the first control signal CONT1. The gate driver 300 may sequentially output the gate signals to the gate lines GL.

In an exemplary embodiment of the present inventive concept, the gate driver 300 may be disposed, e.g., directly mounted, on the display panel 100, or may be connected to the display panel 100 in a tape carrier package ("TCP") type. In an exemplary embodiment of the present inventive concept, the gate driver 300 may be integrated on the display panel 100.

The gamma reference voltage generator 400 generates a gamma reference voltage VGREF. The gamma reference voltage generator 400 provides the gamma reference voltage VGREF to the data driver 500. The gamma reference voltage VGREF may have values corresponding to grayscales of the plurality of output pixel data included in the output image data RGBD'.

In an exemplary embodiment of the present inventive concept, the gamma reference voltage generator 400 may include a resistor string circuit (not illustrated) having a plurality of resistors connected in series between a power supply voltage and a ground voltage. The gamma reference voltage generator generates the gamma reference voltage VGREF by dividing the power supply voltage based on the grayscales of the plurality of output pixel data included in the output image data RGBD'. Although not illustrated in FIG. 1, the gamma reference voltage generator 400 may be located inside the data driver 500.

The data driver 500 receives the second control signal CONT2 and the output image data RGBD' from the timing controller 200. The data driver 500 receives the gamma reference voltage VGREF from the gamma reference voltage generator 400. The data driver 500 generates analog data voltages based on the second control signal CONT2, the output image data RGBD', and the gamma reference voltage VGREF. The data driver 500 may sequentially output the analog data voltages to the data lines DL.

In an exemplary embodiment of the present inventive concept, the data driver 500 may include a shift register (not illustrated), a latch (not illustrated), a signal processor (not illustrated), and a buffer (not illustrated). The shift register may output a latch pulse to the latch. The latch may temporarily store the output image data RGBD', and may output the output image data RGBD' to the signal processor. The signal processor may generate the analog data voltages based on the digital output image data RGBD' and the gamma reference voltage VGREF, and may output the analog data voltages to the buffer. The buffer may output the analog data voltages to the data lines DL.

In an exemplary embodiment of the present inventive concept, the data driver 500 may be disposed, e.g., directly mounted, on the display panel 100, or may be connected to the display panel 100 in a tape carrier package ("TCP") type. In an exemplary embodiment of the present inventive concept, the data driver 500 may be integrated on the display panel 100.

Figure 2:
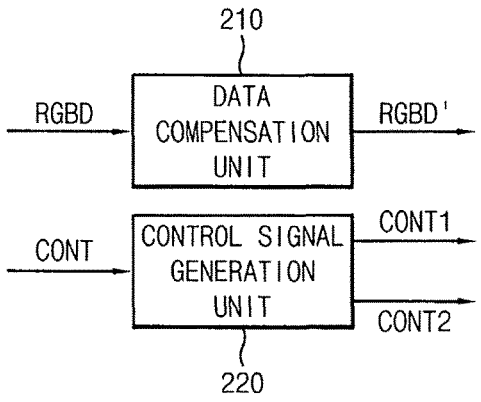
FIG. 2 is a block diagram of a timing controller in the display apparatus of FIG. 1 according to an exemplary embodiment of the present inventive concept.

FIG. 2 is a block diagram of a timing controller in the display apparatus of FIG. 1 according to an exemplary embodiment of the present inventive concept.

Referring to FIGS. 1 and 2, the timing controller 200 may include a data compensation unit 210 and a control signal generation unit 220. The timing controller 200 is illustrated as being divided into two elements for convenience of explanation, however, the timing controller 200 may not be physically divided.

The data compensation unit 210 may receive the input image data RGBD and may generate the output image data RGBD' by selectively compensating the input image data RGBD. For example, as described above with reference to FIG. 1, the input image data RGBD may include the plurality of input pixel data for the plurality of pixels. As will be described with reference to FIG. 5, the data compensation unit 210 may determine whether compensation for first pixel data among the plurality of input pixel data is required based on a position of a first pixel in the display panel 100, previous subpixel data for the first pixel, present subpixel data for the first pixel, a compensation avoidance condition, etc., and may selectively compensate the first pixel data. The first pixel data may correspond to the first pixel of the plurality of pixels.

In an exemplary embodiment of the present inventive concept, the data compensation unit 210 may include a single-line memory (not illustrated) that stores pixel data corresponding to a single subpixel row (e.g., a single horizontal line).

The control signal generation unit 220 may receive the input control signal CONT. The control signal generation unit 220 may generate the first control signal CONT1 for the gate driver 300 and the second control signal CONT2 for the data driver 500 based on the input control signal CONT. The control signal generation unit 220 may output the first control signal CONT1 to the gate driver 300 and may output the second control signal CONT2 to the data driver 500.

In an exemplary embodiment of the present inventive concept, the timing controller 200 may further include an adaptive color correction (ACC) unit (not illustrated) and/or a dynamic capacitance compensation (DCC) unit (not illustrated). The ACC unit may receive the input pixel data and may perform an ACC operation on the input pixel data. The ACC unit may compensate grayscales of the input pixel data using a gamma curve. The DCC unit may perform a DCC operation on the input pixel data. The DCC unit may compensate the grayscales of the input pixel data using previous frame image data and present frame image data. According to an exemplary embodiments, the ACC unit and/or the DCC unit may be located prior to or subsequent to the data compensation unit 210.

Figure 3:
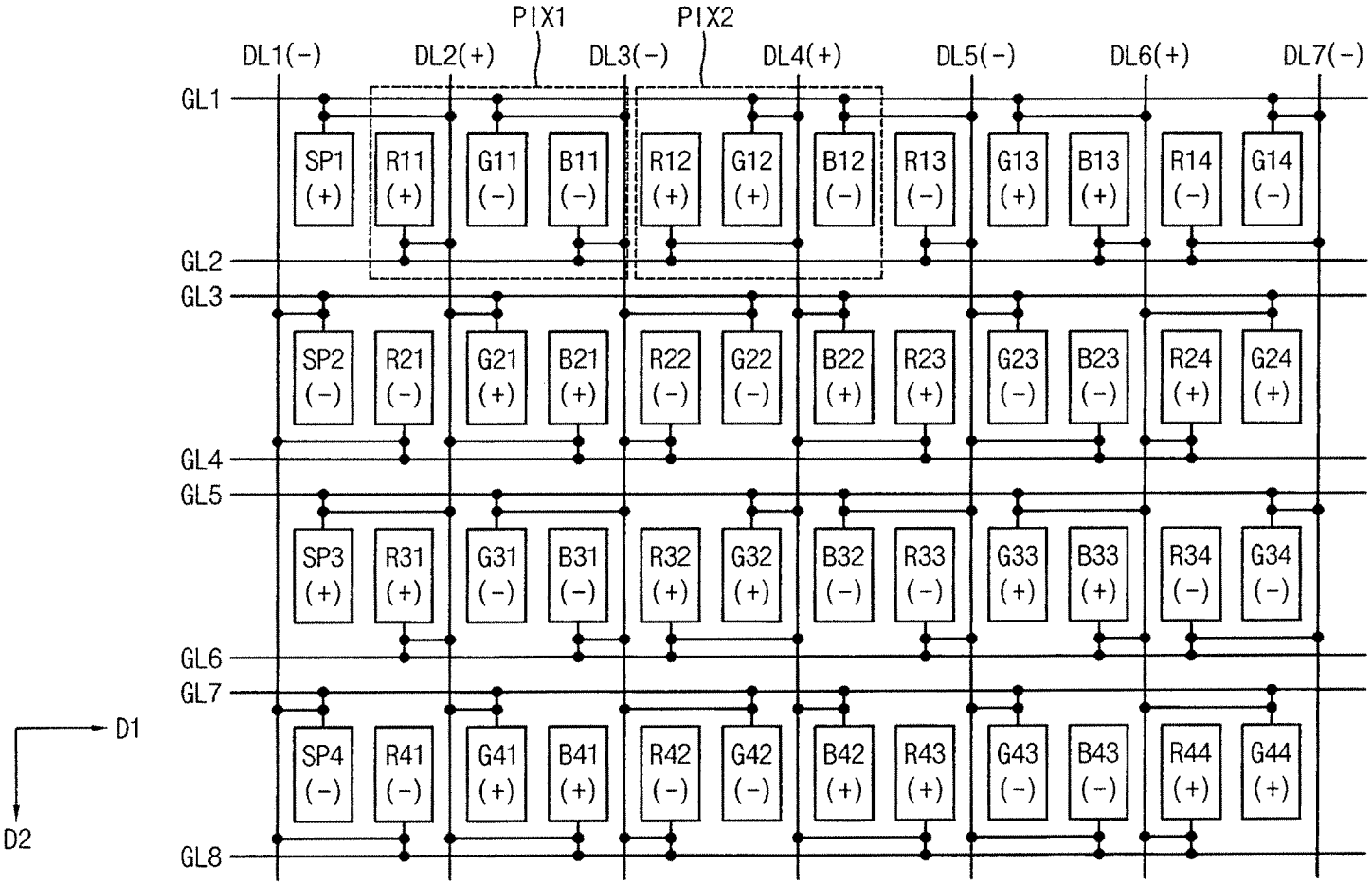
FIG. 3 is a plan view of a display panel in the display apparatus of FIG. 1 according to an exemplary embodiment of the present inventive concept.

FIG. 3 is a plan view of a display panel in the display apparatus of FIG. 1 according to an exemplary embodiment of the present inventive concept.

Referring to FIGS. 1 and 3, the display panel 100 includes the plurality of pixels. Each of the plurality of pixels may include at least two subpixels selected from a plurality of subpixels SP1~SP4, R11~R44, G11~G44, and B11~B44. For example, a first pixel PIX1 may include three subpixels R11, G11, and B11. A second pixel PIX2 may include three subpixels R12, G12, and B12. Subpixels whose name includes "R" represent red subpixels. Subpixels whose name includes "G" represent green subpixels. Subpixels whose name includes "B" represent blue subpixels. Subpixels whose name includes "SP" represent dummy subpixels or blue subpixels.

Hereinafter, the present inventive concept will be described based on an example where one pixel includes three subpixels. However, the present inventive concept is not limited thereto.

Each of the plurality of subpixels SP1~SP4, R11~R44, G11~G44, and B11~B44 may be disposed in one of a plurality of subpixel rows and one of a plurality of subpixel columns.

For example, the subpixels SP1~SP4 may be disposed in a first subpixel column. The red subpixels R11~R41, R12~R42, R13~R43, and R14~R44 may be disposed in a second subpixel column, a fifth subpixel column, an eighth subpixel column, and an eleventh subpixel column, respectively. The green subpixels G11~G41, G12~G42, G13~G43, and G14~G44 may be disposed in a third subpixel column, a sixth subpixel column, a ninth subpixel column, and a twelfth subpixel column, respectively. The blue subpixels B11~B41, B12~B42, and B13~B43 may be disposed in a fourth subpixel column, a seventh subpixel column, and a tenth subpixel column, respectively.

The subpixels SP1, R11, G11, B11, R12, G12, B12, R13, G13, B13, R14, and G14 may be disposed in a first subpixel row. The subpixels SP2, R21, G21, B21, R22, G22, B22, R23, G23, B23, R24, and G24 may be disposed in a second subpixel row. The subpixels SP3, R31, G31, B31, R32, G32, B32, R33, G33, B33, R34, and G34 may be disposed in a third subpixel row. The subpixels SP4, R41, G41, B41, R42, G42, B42, R43, G43, B43, R44, and G44 may be disposed in a fourth subpixel row.

In addition, each of the plurality of subpixels SP1~SP4, R11~R44, G11~G44, and B11~B44 may be connected to one of a plurality of gate lines GL1~GL8 and one of a plurality of data lines DL1~DL7.

For example, subpixels SP1, G11, G12, B12, G13, and G14 in the first subpixel row may be connected to the first gate line GL1, and subpixels R11, B11, R12, R13, B13, and R14 in the first subpixel row may be connected to the second gate line GL2. Subpixels SP2, G21, G22, B22, G23, and G24 in the second subpixel row may be connected to the third gate line GL3, subpixels R21, B21, R22, R23, B23, and R24 in the second subpixel row may be connected to the fourth gate line GL4. Subpixels SP3, G31, G32, B32, G33, and G34 in the third subpixel row may be connected to the fifth gate line GL5, and subpixels R31, B31, R32, R33, B33, and R34 in the third subpixel row may be connected to the sixth gate line GL6. Subpixels SP4, G41, G42, B42, G43, and G44 in the fourth subpixel row may be connected to the seventh gate line GL7, and subpixels R41, B41, R42, R43, B43, and R44 in the fourth subpixel row may be connected to the eighth gate line GL8.

In addition, subpixels SP2, R21, SP4, and R41 in the first and second subpixel columns may be connected to the first data line DL1, and subpixels SP1, R11, SP3, and R11 in the first and second subpixel columns may be connected to the second data line DL2. Subpixels G21, B21, G41, and B41 in the third and fourth subpixel columns may be connected to the second data line DL2, and subpixels G11, B11, G11, and B11 in the third and fourth subpixel columns may be connected to the third data line DL3. Subpixels R22, G22, R42, and G42 in the fifth and sixth subpixel columns may be connected to the third data line DL3, and subpixels R12, G12, R32, and G32 in the fifth and sixth subpixel columns may be connected to the fourth data line DL4. Subpixels B22, R23, B42, and R43 in the seventh and eighth subpixel columns may be connected to the fourth data line DL4, and subpixels B12, R13, B32, and R33 in the seventh and eighth subpixel columns may be connected to the fifth data line DL5. Subpixels G23, B23, G43, and B43 in the ninth and tenth subpixel columns may be connected to the fifth data line DL5, and subpixels G13, B13, G33, and B33 in the ninth and tenth subpixel columns may be connected to the sixth data line DL6. Subpixels R24, G24, R44, and G44 in the eleventh and twelfth subpixel columns may be connected to the sixth data line DL6, and subpixels R14, G14, R34 and G34 in the eleventh and twelfth subpixel columns may be connected to the seventh data line DL7.

For example, subpixels in each subpixel row may be electrically connected to one of two gate lines, and subpixels of two adjacent subpixel columns may be electrically connected to two adjacent data lines.

Each of the data lines DL1~DL7 may be, alternately in a column direction, connected to two subpixels at a left side with respect to each of the data lines DL1~DL7 or may be connected to two subpixels at a right side with respect to each of the data lines DL1~DL7. For example, the second data line DL2 may be sequentially connected to the subpixels SP1 and R11 (e.g., two subpixels at the left side of the data line DL2) in the first and second subpixel columns, the subpixels G21 and B21 (e.g., two subpixels at the right side of the data line DL2) in the third and fourth subpixel columns, the subpixels SP3 and R31 (e.g., two subpixels at the left side of the data line DL2) in the first and second subpixel columns, and the subpixels G41 and B41 (e.g., two subpixels at the right side of the data line DL2) in the third and fourth subpixel columns.

For example, subpixels in the two adjacent subpixel columns may be alternately connected to two adjacent data lines by a unit of two subpixels. For example, in the first and second subpixel columns, two subpixels SP1 and R11 in the first subpixel row may be connected to the second data line DL2, two subpixels SP2 and R21 in the second subpixel row may be connected to the first data line DL1, two subpixels SP3 and R31 of the third subpixel row may be connected to the second data line DL2, and two subpixels SP4 and 431 of the fourth subpixel row may be connected to the first data line DL1.

Data voltages (e.g., analog data voltage signals) may be applied to data lines DL1~DL7 in a frame. Polarities of the data voltages may be inverted in a next frame.

For example, during a first frame, data voltages having a negative polarity (−) may be applied to the first, third, fifth, and seventh data lines DL1, DL3, DL5, and DL7, and data voltages having a positive polarity (+) may be applied to the second, fourth, and sixth data lines DL2, DL4, and DL6. Accordingly, data voltage applied with subpixels of the display panel 100 may have may be inverted in polarity for each row (e.g., referred to as a polarity pattern of a dot inversion). For example, each of the first and third subpixel rows may have a polarity pattern of "+, +, −, −, +, +, −, −, +, +, −, −", and each of the second and fourth subpixel rows may have a polarity pattern of "−, −, +, +, −, −, +, +, −, −, +, +" which is opposite to two adjacent subpixels. Therefore, the display panel 100 may have a polarity pattern of a dot inversion where two adjacent subpixels in a subpixel row have the same polarity as each other and two adjacent subpixels are surrounded by subpixels having a polarity which is opposite to that of the two adjacent subpixels in the subpixel.

Although not illustrated in FIG. 3, during a second frame subsequent to the first frame, data voltages having the positive polarity (+) may be applied to the first, third, fifth, and seventh data lines DL1, DL3, DL5, and DL7, and data voltages having the negative polarity (−) may be applied to the second, fourth, and sixth data lines DL2, DL4, and DL6. As explained above, the display panel 100 may have a polarity pattern of a dot inversion. Each of the first and third subpixel rows may have a polarity pattern of "−, −, +, +, −, −, +, +, −, −, +, +", and each of the second and fourth subpixel rows may have a polarity pattern of "+, +, −, −, +, +, −, −, +, +, −, −" which is opposite to that of each of the first and third subpixel rows.

Thus, using a column inversion method which provides data voltages having opposite polarities to adjacent data lines, the display panel 100 may have a dot inversion effect in which subpixels are inverted in polarity for every two columns in the first direction D1 (e.g., in a row direction) and subpixels are inverted in polarity for every row in the second direction D2 (e.g., in a column direction).

Figure 4:
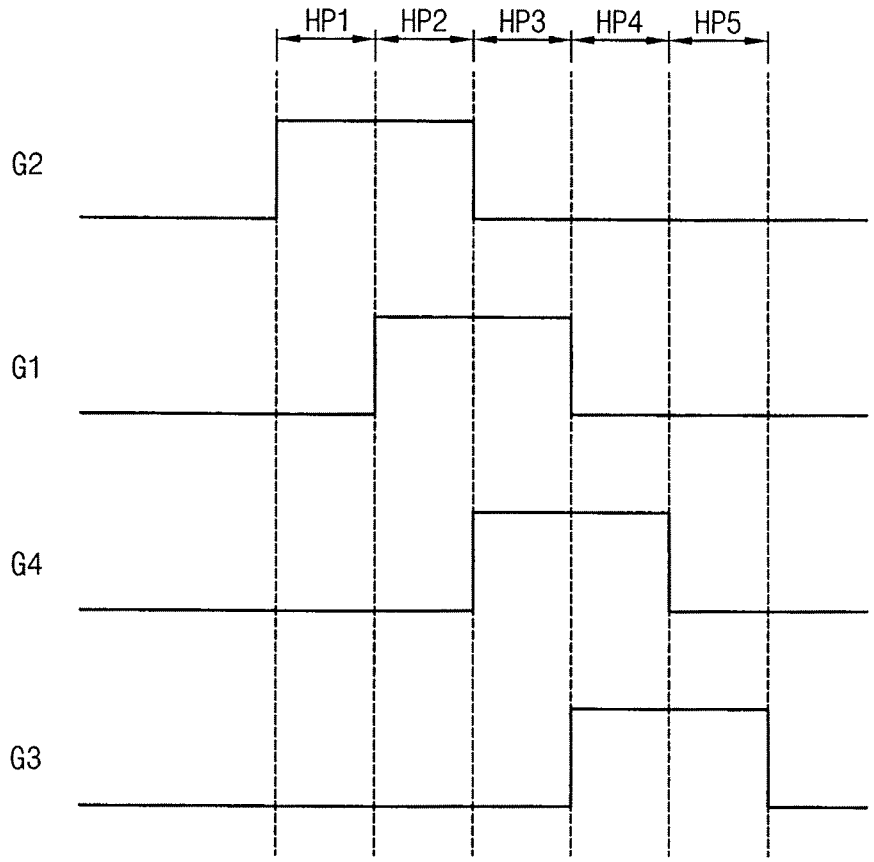
FIG. 4 is a timing diagram illustrating gate signals applied to gate lines of the display panel of FIG. 3 according to an exemplary embodiment of the present inventive concept.

FIG. 4 is a timing diagram of gate signals applied to gate lines of the display panel of FIG. 3 according to an exemplary embodiment of the present inventive concept.

Referring to FIGS. 1, 3, and 4, the display panel 100 of the display apparatus according to an exemplary embodiment of the present inventive concept may operate based on a precharge driving scheme. In the precharge driving scheme, a gate signal may have an ON (e.g., a logical high state) level during at least two successive horizontal periods to increase a charging duration. One horizontal period may correspond to a duration for charging a subpixel with a data voltage.

For simplicity of explanation, four gate signals G1~G4 applied to first four gate lines GL1~GL4, respectively are described in FIG. 4. The gate signals G1~G4 may be sequentially applied to the gate lines GL1~GL4, respectively. The sequence of applying gate signals may be G2→G1→G4→G3.

In FIG. 4, each of the gate signals G1~G4 may include the ON level during two successive horizontal periods. During a first horizontal period of two successive horizontal periods, a precharge voltage may be applied to a subpixel through a data line. During a second horizontal period of two successive horizontal periods, a charging voltage may be applied to the subpixel through the data line. Thus, the subpixel may be charged during two successive horizontal periods by the precharge voltage and the charging voltage. The charging voltage may be interchangeably used with the data voltage.

For example, the second gate signal G2 applied to the second gate line GL2 may have the ON level during two successive horizontal periods from a first horizontal period HP1 to a second horizontal period HP2. The first gate signal G1 applied to the first gate line GL1 may have the ON level during two successive horizontal periods from the second horizontal period HP2 to a third horizontal period HP3. The fourth gate signal G4 applied to the fourth gate line GL4 may have the ON level during two successive horizontal periods from the third horizontal period HP3 to a fourth horizontal period HP4. The third gate signal G3 applied to the third gate line GL3 may have the ON level during two successive horizontal periods from the fourth horizontal period HP4 to a fifth horizontal period HP5.

The subpixels connected to the second gate line GL2 may be precharged based on the precharge voltage during the first horizontal period HP1 and may be mainly charged based on the charging voltage during the second horizontal period HP2. The subpixels connected to the first gate line GL1 may be precharged based on the precharge voltage during the second horizontal period HP2 and may be mainly charged based on the charging voltage during the third horizontal period HP3. The subpixels connected to the fourth gate line GL4 may be precharged based on the precharge voltage during the third horizontal period HP3 and may be mainly charged based on the charging voltage during the fourth horizontal period HP4. The subpixels connected to the third gate line GL3 may be precharged based on the precharge voltage during the fourth horizontal period HP4 and may be mainly charged based on the charging voltage during the fifth horizontal period HP5.

In an exemplary embodiment of the present inventive concept, data in a subpixel stored by the precharge operation may correspond to previous subpixel data, and data in the subpixel stored by the charge operation (e.g., a main-charge operation) may correspond to present subpixel data.

Referring to FIG. 3, for example, the first pixel PIX1 may include the subpixels R11, G11, and B11. The first subpixel R11 may be connected to the second data line DL2. The second and third subpixels G11 and B11 may be connected to the third data line DL3. As illustrated in FIG. 4, the first and second gate signals G1 and G2 may be simultaneously activated during the second horizontal period HP2, and thus, the third subpixel B11 may be mainly charged based on a data voltage provided from the third data line DL3 during the second horizontal period HP2, and the second subpixel G11 may be precharged based on the data voltage provided from the third data line DL3 during the second horizontal period HP2. The second subpixel G11 may be mainly charged based on a data voltage provided from the third data line DL3 during the third horizontal period HP3.

For example, data in the third subpixel B11 stored by the main-charge operation during the second horizontal period HP2 may be substantially the same as data in the second subpixel G11 stored by the precharge operation during the second horizontal period HP2. Thus, data in the second subpixel G11 stored by the main-charge operation during the third horizontal period HP3 may be referred to as present subpixel data of the first pixel the data in the third subpixel B11 stored by the main-charge operation during the second horizontal period HP2 may be referred to as previous subpixel data of the first pixel.

Hereinafter, a method of driving a display panel according to an exemplary embodiment of the present inventive concept will be described with reference to FIGS. 1, 3, and 4.

Figure 5:
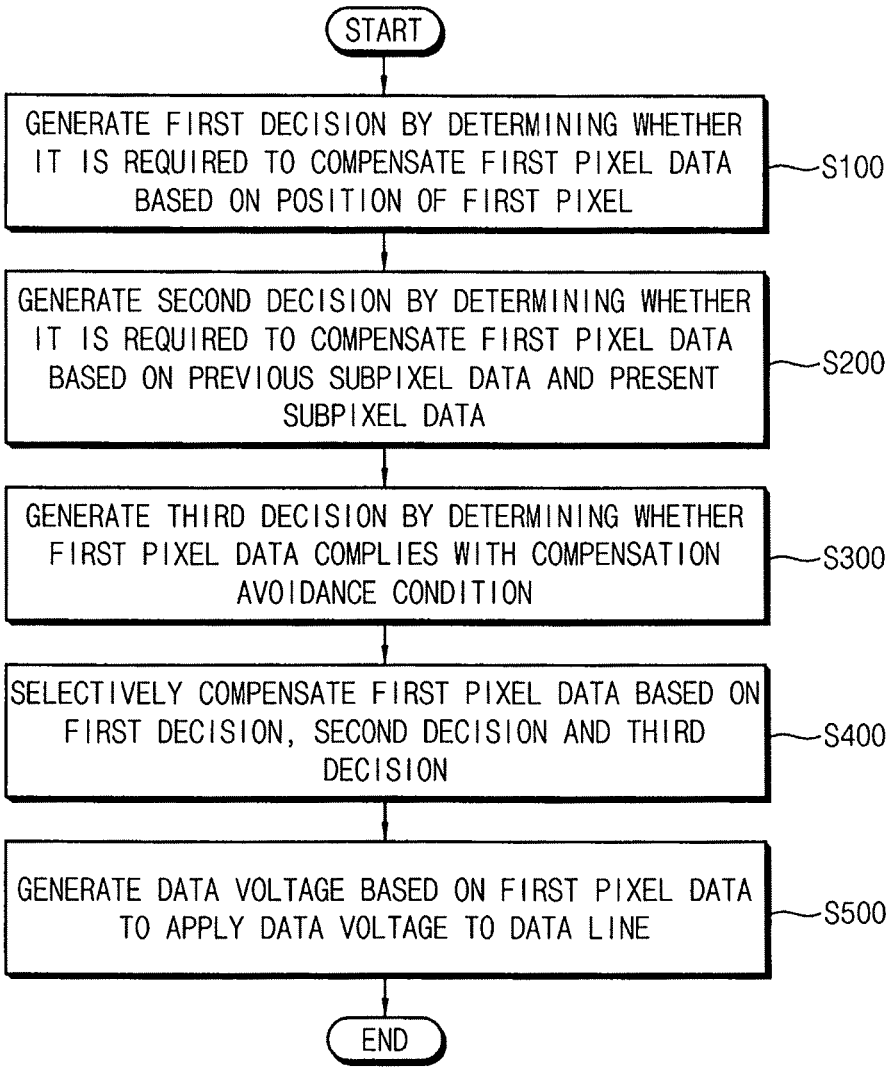
FIG. 5 is a flow chart illustrating a method of driving a display panel according to an exemplary embodiment of the present inventive concept.

FIG. 5 is a flow chart illustrating a method of driving a display panel according to an exemplary embodiment of the present inventive concept.

Referring to FIGS. 1, 2, 3, and 5, in the method of driving the display panel 100 according to an exemplary embodiment of the present inventive concept, a first decision as to whether compensation for first pixel data corresponding to the first pixel PIX1 is required may be made based on a position of the first pixel PIX1 in the display panel 100 (step S100). The first pixel PIX1 may be one of the plurality of pixels included in the display panel 100. The first pixel data may be one of the plurality of input pixel data included in the input image data RGBD.

A second decision as to whether the compensation for the first pixel data is required may be made based on previous subpixel data and present subpixel data for the first pixel PIX1 (step S200). As described above with reference to FIGS. 3 and 4, the first pixel PIX1 may include the first subpixel R11 operating based on first subpixel data, the second subpixel G11 operating based on the present subpixel data, and the third subpixel B11 operating based on the previous subpixel data. In this case, the first pixel data may include the first subpixel data, the present subpixel data, and the previous subpixel data.

A third decision as to whether the first pixel data complies with a compensation avoidance condition may be made (step S300). The first pixel data is selectively compensated based on the first decision, the second decision and the third decision (step S400). For example, the first pixel data may be compensated by changing grayscales of the first pixel data.

A data voltage is generated based on the first pixel data to be applied to a data line (e.g., DL2 or DL3 in FIG. 3) connected to the first pixel PIX1 (step S500).

In an exemplary embodiment of the present inventive concept, the steps S100, S200, S300, and S400 in FIG. 5 may be performed by the data compensation unit 210 included in the timing controller 200. The step S500 in FIG. 5 may be performed by the data driver 500.

Although not illustrated in FIG. 5, a gate signal having an ON level during at least two continuous horizontal periods may be applied, e.g., by the gate driver 300, to a gate line (e.g., GL1 and GL2 in FIG. 3) connected to the first pixel PIX1.

In the method of driving the display panel 100 described above with reference to FIG. 5, the first pixel data for the first pixel PIX1 may be selectively compensated based on the position of the first pixel PIX1 in the display panel 100, the present subpixel data for the first pixel PIX1, the previous subpixel data for the first pixel PIX1, and the compensation avoidance condition. Accordingly, defects (e.g., a horizontal/vertical spot line and/or discontinuity of grayscales) on the display panel 100 may be reduced, and thus a display quality of the display panel 100 may be increased.

Figure 6:
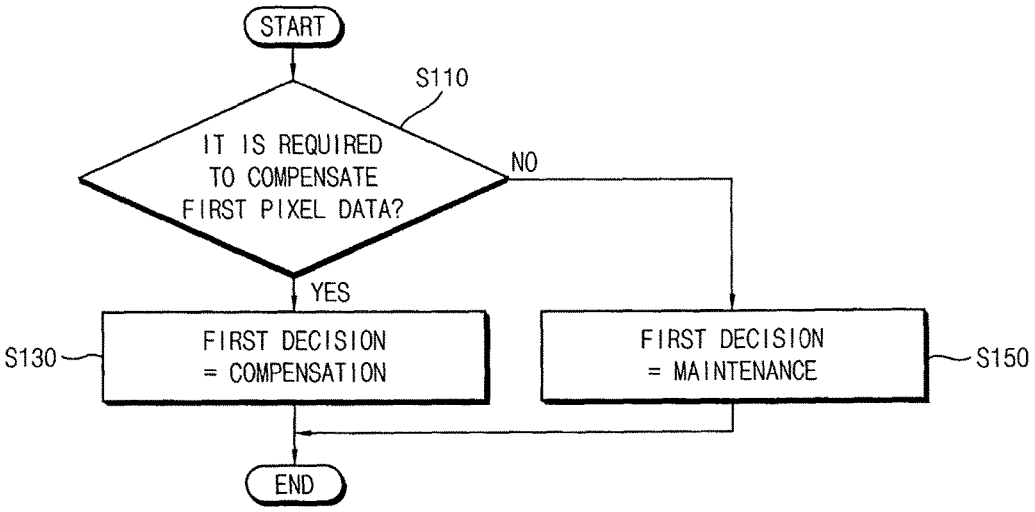
FIG. 6 is a flow chart illustrating an example of performing a first decision of FIG. 5 according to an exemplary embodiment of the present inventive concept.

FIG. 6 is a flow chart illustrating an example of performing a first decision of FIG. 5 according to an exemplary embodiment of the present inventive concept.

Referring to FIGS. 1, 2, 3, 5, and 6, the first decision of the step S100 may include determining whether the compensation for the first pixel data is required (step S110). For example, the determining of whether the compensation for the first pixel data is required may be made based on: whether the first pixel PIX1 is disposed in an area (e.g., a compensation area) of the display panel 100 where compensation is required and/or; whether an image displayed on the display panel 100 causes a defect on the display panel 100 (e.g., whether the image displayed on the display panel 100 corresponds to a defect causable image).

When the compensation for the first pixel data is required (step S110: YES), e.g., when the first pixel PIX1 is disposed in the compensation area and/or when the image displayed on the display panel 100 corresponds to the defect causable image, the first decision may be made to compensate the first pixel data (step S130).

When the compensation for the first pixel data is not required (step S110: NO), e.g., when the first pixel PIX1 is disposed in an area other than the compensation area and/or when the image displayed on the display panel 100 does not correspond to the defect causable image, the first decision may be made not to compensate (e.g., maintain) the first pixel data (step S150).

In an exemplary embodiment of the present inventive concept, the steps S110, S130, and S150 in FIG. 6 may be performed by the data compensation unit 210 included in the timing controller 200.

Figure 7:
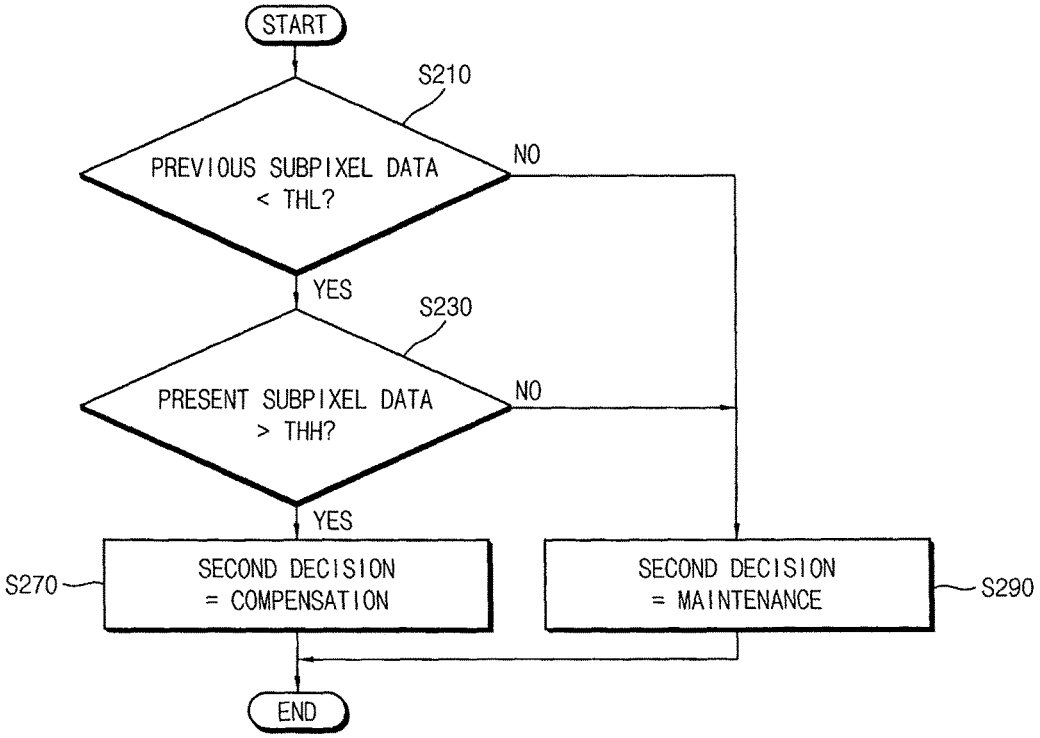
FIGS. 7, 8 and 9 are flow charts illustrating examples of performing a second decision of FIG. 5 according to an exemplary embodiment of the present inventive concept.
Figure 8:
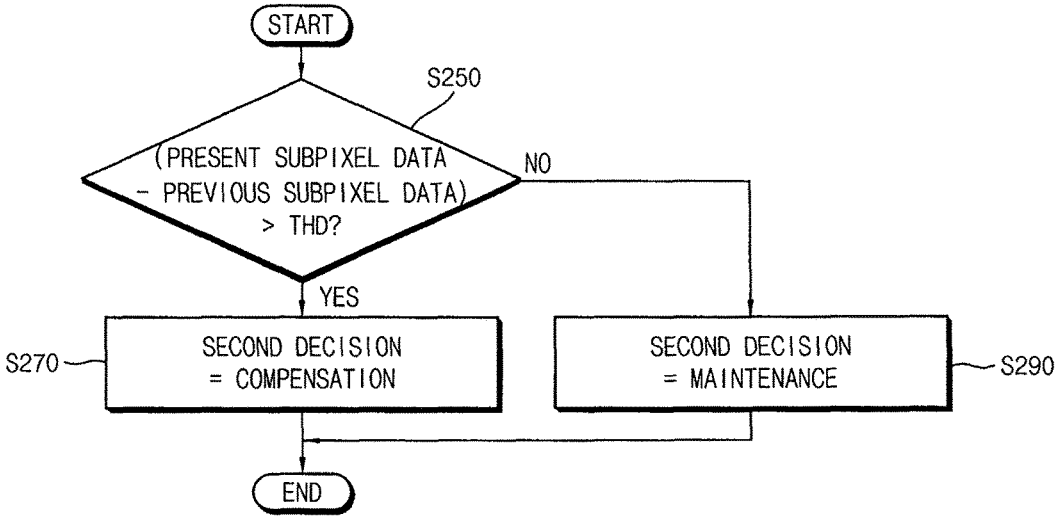
Figure 9:
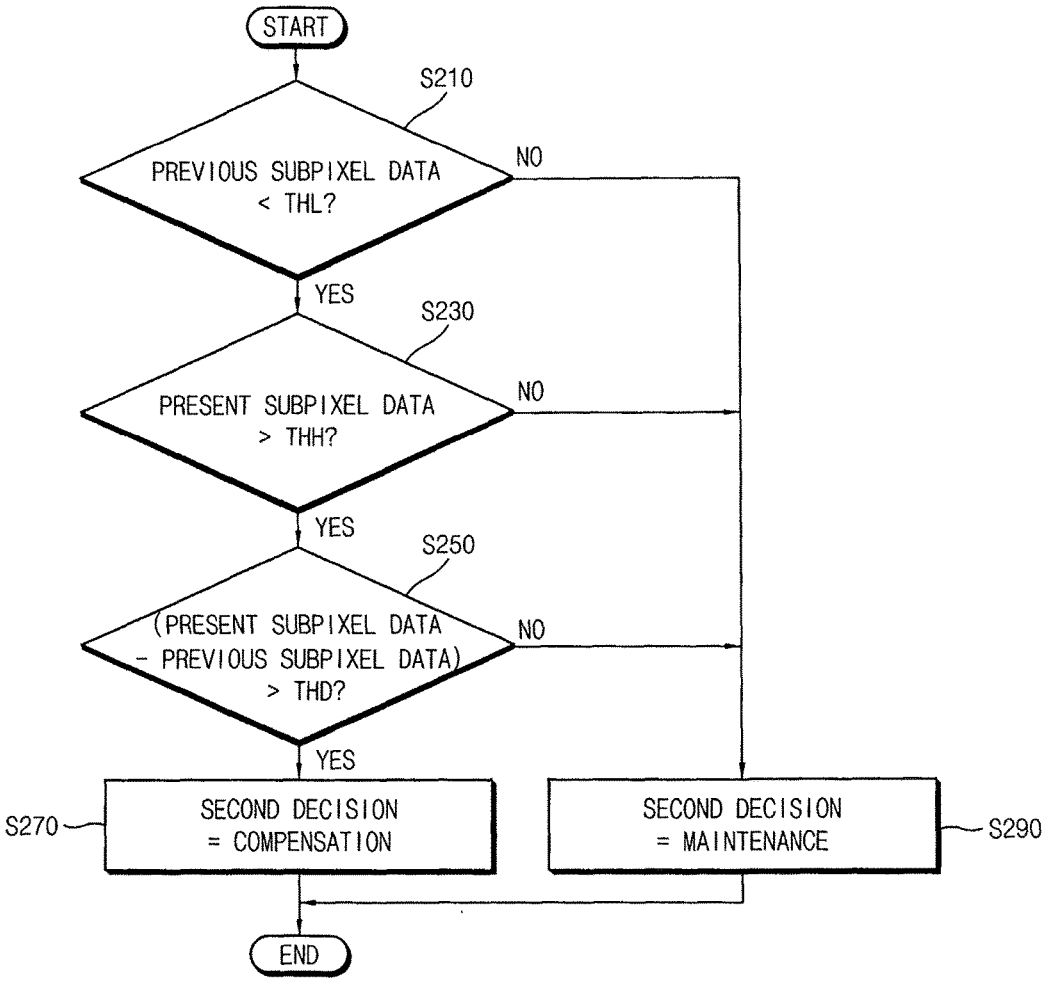

FIGS. 7, 8, and 9 are flow charts illustrating examples of performing a second decision of FIG. 5 according to an exemplary embodiment of the present inventive concept.

Referring to FIGS. 1, 2, 3, 5, and 7, in the step S200, the previous subpixel data for operating the third subpixel B11 may be compared with first threshold data THL (step S210). The first threshold data THL may have a value corresponding to a relatively low grayscale that is less than a middle grayscale. For example, the first threshold data THL may have a value close to a minimum grayscale. For another example, the first threshold data THL may correspond to a substantially black grayscale of the normal black mode. The first threshold data THL may be set by a user.

The present subpixel data for operating the second subpixel G11 may be compared with second threshold data THH (step S230). The second threshold data THH may have a value corresponding to a relatively high grayscale that is greater than the middle grayscale. For example, the second threshold data THH may have a value close to a maximum grayscale. For another example, the second threshold data THH may correspond to a substantially white grayscale in the normal black mode. The second threshold data THH may be set by a user.

When a value of the previous subpixel data is smaller than a value of the first threshold data THL (step S210: YES), and when a value of the present subpixel data is greater than a value of the second threshold data THH (step S230: YES), the second decision may be made to compensate the first pixel data (step S270).

When the value of the previous subpixel data is equal to or greater than the value of the first threshold data THL (step S210: NO), or when the value of the present subpixel data is equal to or smaller than the value of the second threshold data THH (step S230: NO), the second decision may be made not to compensate (e.g., maintain) the first pixel data (step S290).

In an exemplary embodiment of the present inventive concept, the steps S210, S230, S270, and S290 in FIG. 7 may be performed by the data compensation unit 210 included in the timing controller 200.

Referring to FIGS. 1, 2, 3, 5, and 8, in the step S200, first difference data may be compared with third threshold data THD (step S250). For example, the first difference data may correspond to a difference in grayscale between the present subpixel data for operating the second subpixel G11 and the previous subpixel data for operating the third subpixel B11. The third threshold data THD may be set to a predetermined grayscale that might cause a defect. When a difference in grayscale between the present subpixel data for operating the second subpixel G11 and the previous subpixel data for operating the third subpixel B11 is greater than the predetermined grayscale of the third threshold data THD, the present subpixel data may be insufficiently charged because the subpixel is precharged with a relatively low grayscale of the previous subpixel data. The third threshold data THD may be set by a user.

When a value of the first difference data is greater than a value (e.g., a grayscale) of the third threshold data THD (step S250: YES), the second decision may be made to compensate the first pixel data (step S270).

When the value of the first difference data is equal to or smaller than the value of the third threshold data THD (step S250: NO), the second decision may be made not to compensate (e.g., maintain) the first pixel data (step S290).

In an exemplary embodiment of the present inventive concept, the steps S250, S270, and S290 in FIG. 8 may be performed by the data compensation unit 210 included in the timing controller 200.

Referring to FIGS. 1, 2, 3, 5, and 9, in the step S200, the previous subpixel data for operating the third subpixel B11 may be compared with the first threshold data THL (step S210). The present subpixel data for operating the second subpixel G11 may be compared with the second threshold data THH (step S230). The first difference data corresponding to the difference in grayscale between the present subpixel data and the previous subpixel data may be compared with the third threshold data THD (step S250). The steps S210 and S230 in FIG. 9 may be substantially the same as the steps S210 and S230 in FIG. 7, respectively. In addition, the step S250 in FIG. 9 may be substantially the same as the step S250 in FIG. 8.

When a value of the previous subpixel data is smaller than a value of the first threshold data THL (step S210: YES), when a value of the present subpixel data is greater than a value of the second threshold data THH (step S230: YES), and when a value of the first difference data is greater than a value of the third threshold data THD (step S250: YES), the second decision may be made to compensate the first pixel data (step S270).

When the value of the previous subpixel data is equal to or greater than the first threshold data THL (step S210: NO), when the value of the present subpixel data is equal to or smaller than the value of the second threshold data THH (step S230: NO), or when the value of the first difference data is equal to or smaller than the value of the third threshold data THD (step S250: NO), the second decision may be made not to compensate (e.g., maintain) the first pixel data (step S290).

In an exemplary embodiment of the present inventive concept, the steps S210, S230, S250, S270, and S290 in FIG. 9 may be performed by the data compensation unit 210 included in the timing controller 200.

Figure 10:
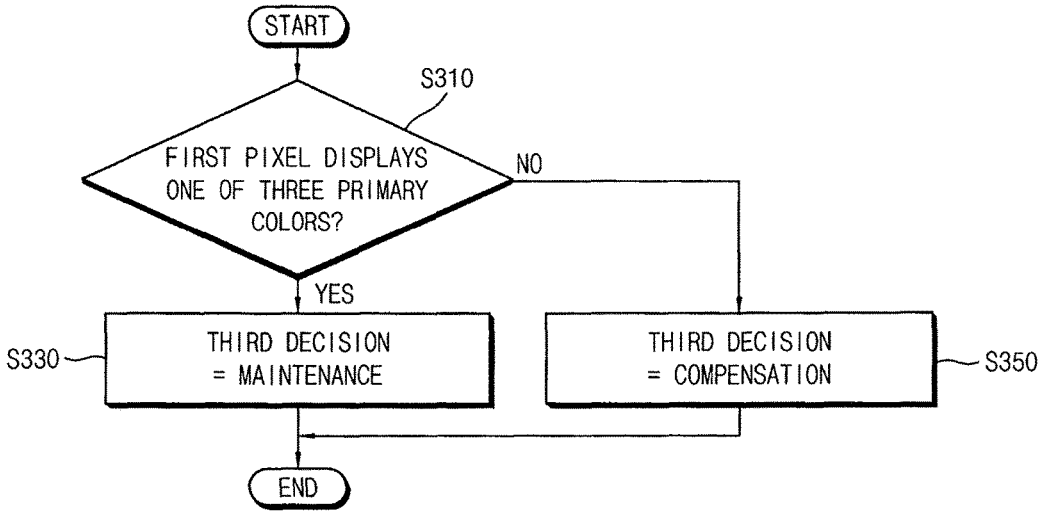
FIGS. 10 and 11 are flow charts illustrating examples of performing a third decision of FIG. 5 according to an exemplary embodiment of the present inventive concept.
Figure 11:
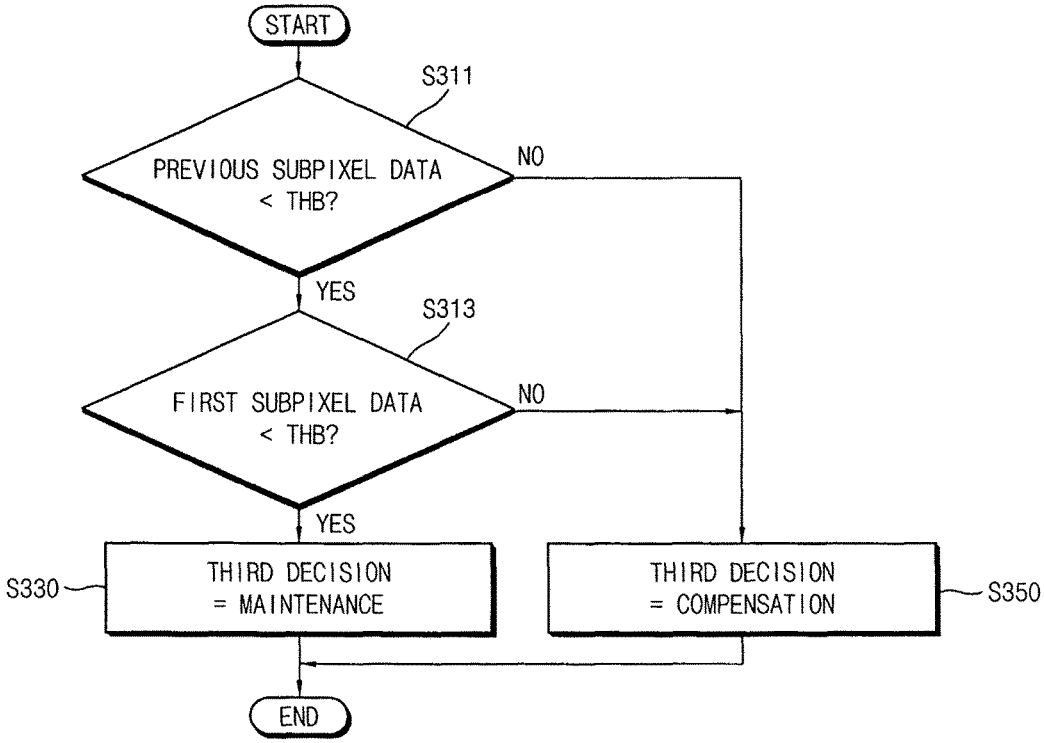

FIGS. 10 and 11 are flow charts illustrating examples of performing a third decision of FIG. 5 according to an exemplary embodiment of the present inventive concept.

Referring to FIGS. 1, 2, 3, 5 and 10, in the step S300, a first color displayed by the first pixel PIX1 may be determined based on the first pixel data (step S310). For example, it may be determined whether the first color corresponds to one of three primary colors including red, green, and blue.

When the first pixel PIX1 displays one of the three primary colors (step S310: YES), e.g., when the first color corresponds to one (e.g., green) of the three primary colors, the third decision may be made not to compensate (e.g., maintain) the first pixel data (step S330). For example, when the first pixel PIX1 displays one of the three primary colors, it may represent that the first pixel data complies with the compensation avoidance condition.

When the first pixel PIX1 displays a color other than the three primary colors (step S310: NO), e.g., when the first color does not correspond to one of the three primary colors, the third decision may be made to compensate the first pixel data (step S350).

In an exemplary embodiment of the present inventive concept, the steps S310, S330, and S350 in FIG. 10 may be performed by the data compensation unit 210 included in the timing controller 200.

Referring to FIGS. 1, 2, 3, 5, and 11, in the step S300, the previous subpixel data for operating the third subpixel B11 may be compared with fourth threshold data THB (step S311). The first subpixel data for operating the first subpixel R11 may be compared with the fourth threshold data THB (step S313). The fourth threshold data THB may have a value corresponding to a relatively low grayscale that is less than a middle grayscale. For example, the fourth threshold data THB may have a value close to a minimum grayscale. For another example, the fourth threshold data THB may correspond to a substantially black grayscale of the normal black mode. The fourth threshold data THB may be set by a user.

When a value of the previous subpixel data is smaller than a value of the fourth threshold data THB (step S311: YES), and when a value of the first subpixel data is smaller than a value of the fourth threshold data THB (step S313: YES), it may be determined that the first pixel PIX1 displays one of the three primary colors, and thus, the third decision may be made not to compensate (e.g., maintain) the first pixel data (step S330). For example, when the value of the previous subpixel data is smaller than the value of the fourth threshold data THB, and when the value of the first subpixel data is smaller than the value of the fourth threshold data THB, it may represent that the first pixel data complies with the compensation avoidance condition. For example, when RGB grayscales of the first pixel data is (0, 128, 0), it may be determined that the first pixel PIX1 displays a green color that is one of the three primary colors.

When the value of the previous subpixel data is equal to or greater than the value of the fourth threshold data THB (step S311: NO), or when the value of the first subpixel data is equal to or greater than the value of the fourth threshold data THB (step S313: NO), it may be determined that the first pixel PIX1 displays a color other than the three primary colors, and thus, the third decision may be made to compensate the first pixel data (step S350).

In an exemplary embodiment of the present inventive concept, the steps S311, S313, S330, and S350 in FIG. 11 may be performed by the data compensation unit 210 included in the timing controller 200.

In the method of driving the display panel 100 described above with reference to FIG. 11, it may be determined based on the subpixel data whether the first pixel data complies with the compensation avoidance condition. Accordingly, the number of calculating for detecting the compensation avoidance condition may be reduced, and thus, performance of the display panel 100 may be increased.

Figure 12:
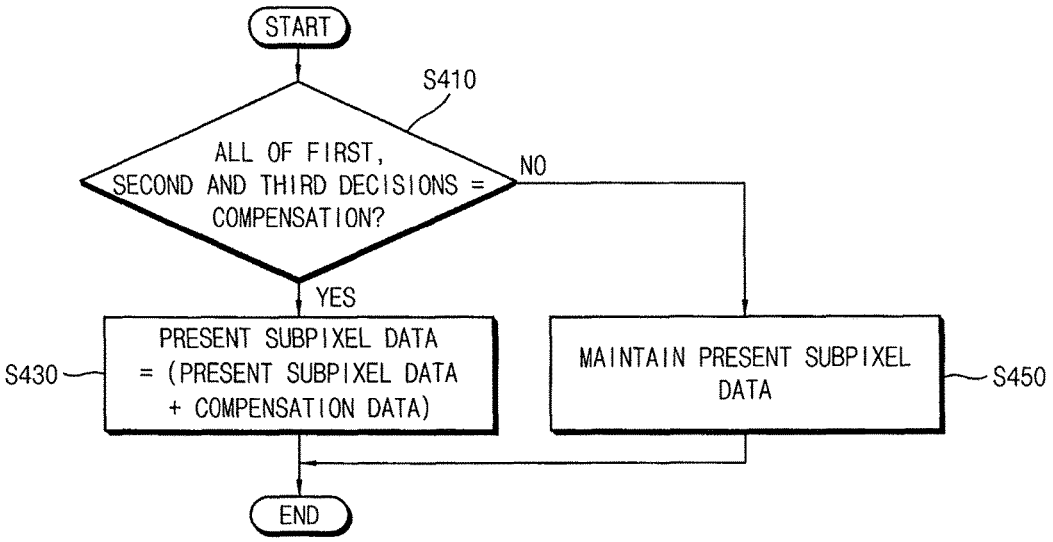
FIGS. 12 and 13 are flow charts illustrating examples of selectively compensating first pixel data in FIG. 5 according to an exemplary embodiment of the present inventive concept.
Figure 13:
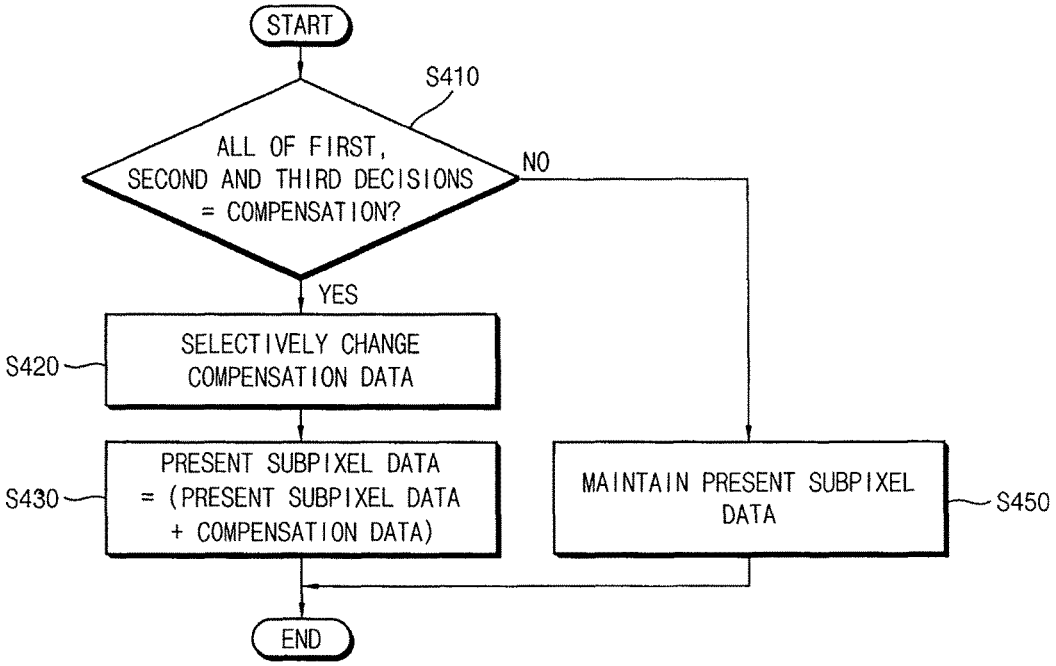

FIGS. 12 and 13 are flow charts illustrating examples of selectively compensating first pixel data in FIG. 5.

Referring to FIGS. 1, 2, 3, 5, and 12, in the step S400, it may be determined whether all of the first decision, the second decision, and the third decision indicate that the compensation for the first pixel data is not required (step S410).

When all of the first decision, the second decision, and the third decision indicate that the compensation for the first pixel data is not required (step S410: YES), the first pixel data may be compensated by adding compensation data to the present subpixel data (step S430). The compensation data may be determined based on a difference in grayscale between the present subpixel data and the previous subpixel data. For example, the data compensation unit 210 may use a conversion function and calculate a compensation grayscale based on the grayscale of the present subpixel data and the grayscale of the previous subpixel data. In an exemplary embodiment of the present inventive concept, the data compensation unit 210 may determine the compensation grayscale using a lookup table that stores the compensation grayscale based on a difference between the grayscale of the present subpixel data and the grayscale of the previous subpixel data.

When at least one of the first decision, the second decision, and the third decision is made that the compensation for the first pixel data is not required (step S410: NO), the first pixel data may not be compensated (for example, the first pixel data may be maintained) (step S450).

In an exemplary embodiment of the present inventive concept, the steps S410, S430, and S450 in FIG. 12 may be performed by the data compensation unit 210 included in the timing controller 200.

Referring to FIGS. 1, 2, 3, 5, and 13, in the step S400, it may be determined whether all of the first decision, the second decision, and the third decision indicate that the compensation for the first pixel data is required (step S410).

When all of the first decision, the second decision, and the third decision indicate that the compensation for the first pixel data is required (step S410: YES), the compensation data may be selectively changed (step S420), and the first pixel data may be compensated by adding compensation data to the present subpixel data (step S430).

When at least one of the first decision, the second decision, and the third decision indicates that the compensation for the first pixel data is not required (step S410: NO), the first pixel data may not be compensated (for example, the first pixel data may be maintained) (step S450).

The steps S410, S430, and S450 in FIG. 13 may be substantially the same as the steps S410, S430, and S450 in FIG. 12, respectively.

In an exemplary embodiment of the present inventive concept, the steps S410, S420, S430, and S450 in FIG. 13 may be performed by the data compensation unit 210 included in the timing controller 200.

Figure 14:
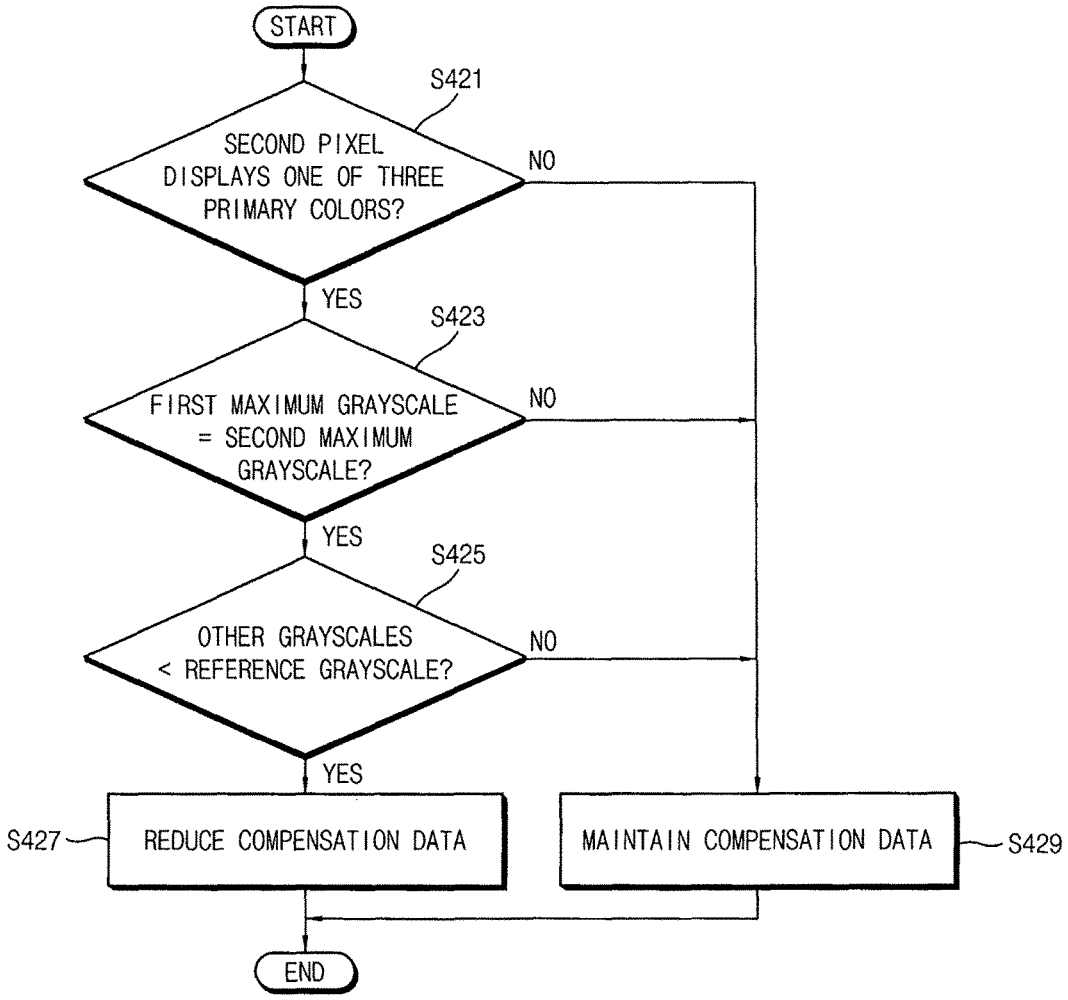
FIG. 14 is a flow chart illustrating an example of selectively changing compensation data in FIG. 13 according to an exemplary embodiment of the present inventive concept.

FIG. 14 is a flow chart illustrating an example of selectively changing compensation data in FIG. 13 according to an exemplary embodiment of the present inventive concept.

Referring to FIGS. 1, 2, 3, 5, 13, and 14, in the step S420, a second color displayed by a second pixel PIX2 may be determined based on second pixel data (step S421) after the first color displayed by the first pixel PIX1 is determined. The second pixel data may correspond to the second pixel PIX2. The second pixel PIX2 may be adjacent to the first pixel PIX1. The first pixel PIX1 and the second pixel PIX2 may be disposed in the same horizontal line (e.g., in a first horizontal line). For example, the first horizontal line may be the first subpixel row in FIG. 3. For example, it may be determined whether the second color corresponds to one of the three primary colors including red, green, and blue colors.

A first maximum grayscale may be compared with a second maximum grayscale (step S423). The first maximum grayscale may be the greatest one of first grayscales of the first color displayed by the first pixel PIX1. The second maximum grayscale may be the greatest one of second grayscales of the second color displayed by the second pixel PIX2. For example, it may be determined whether the first maximum grayscale is substantially the same as the second maximum grayscale.

Grayscales other than the first maximum grayscale among the first grayscales may be compared with a reference grayscale (step S425). For example, it may be determined whether the grayscales other than the first maximum grayscale among the first grayscales are smaller than the reference grayscale. The reference grayscale may be set by a user.

When the second pixel PIX2 displays one (e.g., a green color) of the three primary colors (step S421: YES), and when the first maximum grayscale is substantially the same as the second maximum grayscale (step S423: YES), and when the grayscales other than the first maximum grayscale among the first grayscales are smaller than the reference grayscale (step S425: YES), a value (e.g., a grayscale) of the compensation data may be reduced (step S427). For example, when RGB grayscales of the first pixel data is (20, 128, 0), and when RGB grayscales of the second pixel data is (0, 128, 0), and when the reference grayscale may be about 30, a compensation grayscale corresponding to the value of the compensation data may be reduced.

When the second pixel displays PIX2 a color other than the three primary colors (step S421: NO), when the first maximum grayscale is different from the second maximum grayscale (step S423: NO), or when the grayscales other than the first maximum grayscale among the first grayscales are equal to or greater than the reference grayscale (step S425: NO), the value of the compensation data may be maintained (step S429).

In an exemplary embodiment of the present inventive concept, the steps S421, S423, S425, S427, and S429 in FIG. 14 may be performed by the data compensation unit 210 included in the timing controller 200.

Although FIG. 3 illustrates an example where the second pixel PIX2 is directly adjacent to the first pixel PIX1 in the same horizontal line. However, the present inventive concept is not limited thereto. For example, the second pixel may be spaced apart from the first pixel PIX1 in the same horizontal line. For example, unlike illustrated in FIG. 3, there may be at least one pixel between the first pixel PIX1 and the second pixel PIX2, according to an exemplary embodiment of the present inventive concept.

In the method of driving the display panel 100 described above with reference to FIG. 14, the compensation data may be selectively changed based on the color displayed by an adjacent pixel and/or pixel data corresponding to the adjacent pixel. Accordingly, defects (e.g., a contour artifact) on the display panel 100 may be reduced, and thus, display quality of the display panel 100 may be increased.

Figure 15:
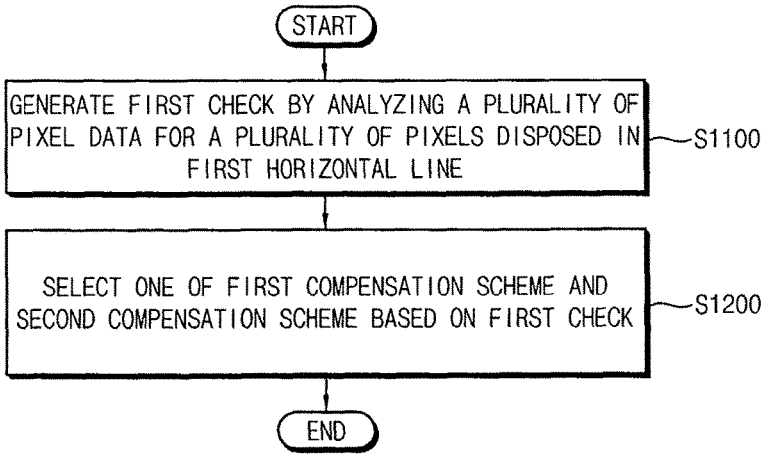
FIG. 15 is a flow chart illustrating a method of driving a display panel according to an exemplary embodiment of the present inventive concept.

FIG. 15 is a flow chart illustrating a method of driving a display panel according to an exemplary embodiment of the present inventive concept.

Referring to FIGS. 1, 2, and 15, in the method of driving the display panel 100 according to an exemplary embodiment of the present inventive concept, a first analyzation result on a plurality of pixel data for a plurality of pixels is generated (step S1100). The plurality of pixels may be disposed in the same horizontal line (e.g., a first horizontal line) of the display panel 100. For example, the first horizontal line may be the first subpixel row in FIG. 3.

Based on the first analyzation result, one of a first compensation method and a second compensation method is selected for the compensation on the plurality of pixel data (step S1200).

The first compensation method may correspond to the method illustrated in FIG. 5. For example, the first compensation method may include performing a first decision based on a position of the first pixel VPIX1 in the display panel 100 as to whether compensation for first pixel data among the plurality of pixel data is required, performing a second decision based on previous and present subpixel data each corresponding to the first pixel VPIX1 as to whether the compensation for the first pixel data is required, performing a third decision as to whether the first pixel data complies with a compensation avoidance condition, and selectively compensating the first pixel data based on the first decision, the second decision, and the third decision. The first pixel data may correspond to the first pixel VPIX1 of the plurality of pixels in the display panel 100. The first compensation method may be performed based on the examples described above with reference to FIGS. 6 through 14. For example, the generating of the first, second, and third decision results and the compensating of the first pixel data may be performed as the examples described above with reference to FIGS. 6 through 14.

The second compensation method may be similar to the method illustrated in FIG. 5, except that the third decision is not made. For example, the second compensation method may include performing the first decision based on the position of the first pixel VPIX1 in the display panel 100 as to whether the compensation for the first pixel data is required, performing the second decision based on previous and present subpixel data each corresponding to the first pixel VPIX1 as to whether the compensation for the first pixel data is required, and selectively compensating the first pixel data based on the first decision and the second decision.

In an exemplary embodiment of the present inventive concept, the steps S1100 and S1200 in FIG. 15 may be performed by the data compensation unit 210 included in the timing controller 200.

Although not illustrated in FIG. 15, the plurality of pixel data may be selectively compensated, e.g., by the data compensation unit 210, based on one of the first compensation method and the second compensation method. Data voltages may be generated, e.g., by the data driver 500, based on the plurality of pixel data to be applied to data lines connected to the plurality of pixels. Gate signals each having an ON level during at least two continuous horizontal periods may be applied, e.g., by the gate driver 300, to gate lines connected to the plurality of pixels.

Although not illustrated in FIG. 15, the steps S1100 and S1200 may be repeated for each of the plurality of horizontal lines (e.g., each of subpixel rows) of the display panel 100.

In the method of driving the display panel 100 described above with reference to FIG. 15, based on analyzation result on the plurality of pixel data corresponding to the plurality of pixels disposed in the same horizontal line, one of the first compensation method and the second compensation method may be selected for the compensation on the plurality of pixel data. Accordingly, defects (e.g., a contour artifact) on the display panel 100 may be reduced, and thus, display quality of the display panel 100 may be increased.

Figure 16:
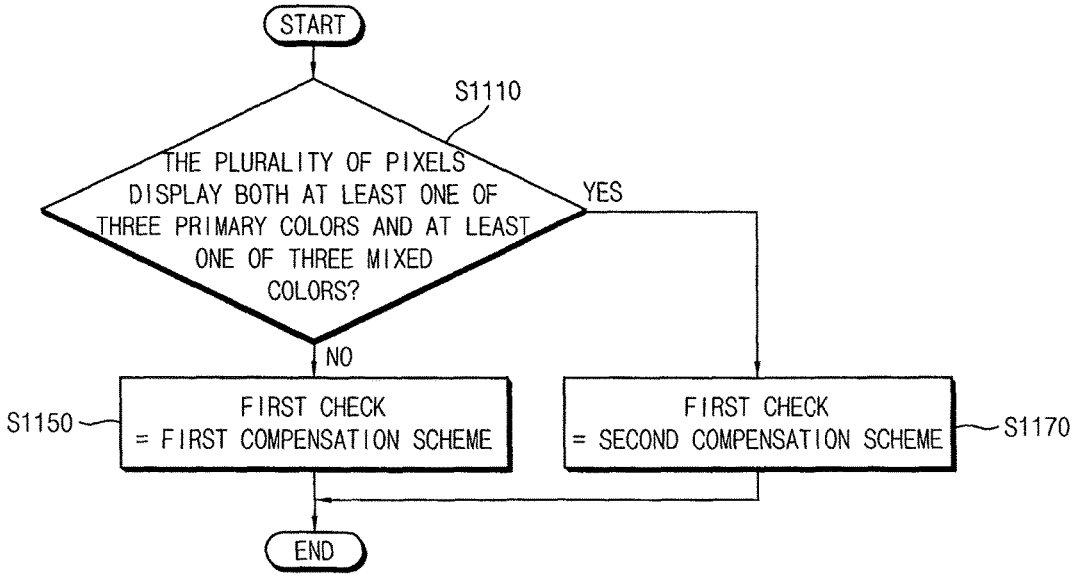
FIGS. 16 and 17 are flow charts illustrating examples of generating a first analyzation result on a plurality of pixel data in FIG. 15 according to an exemplary embodiment of the present inventive concept.
Figure 17:
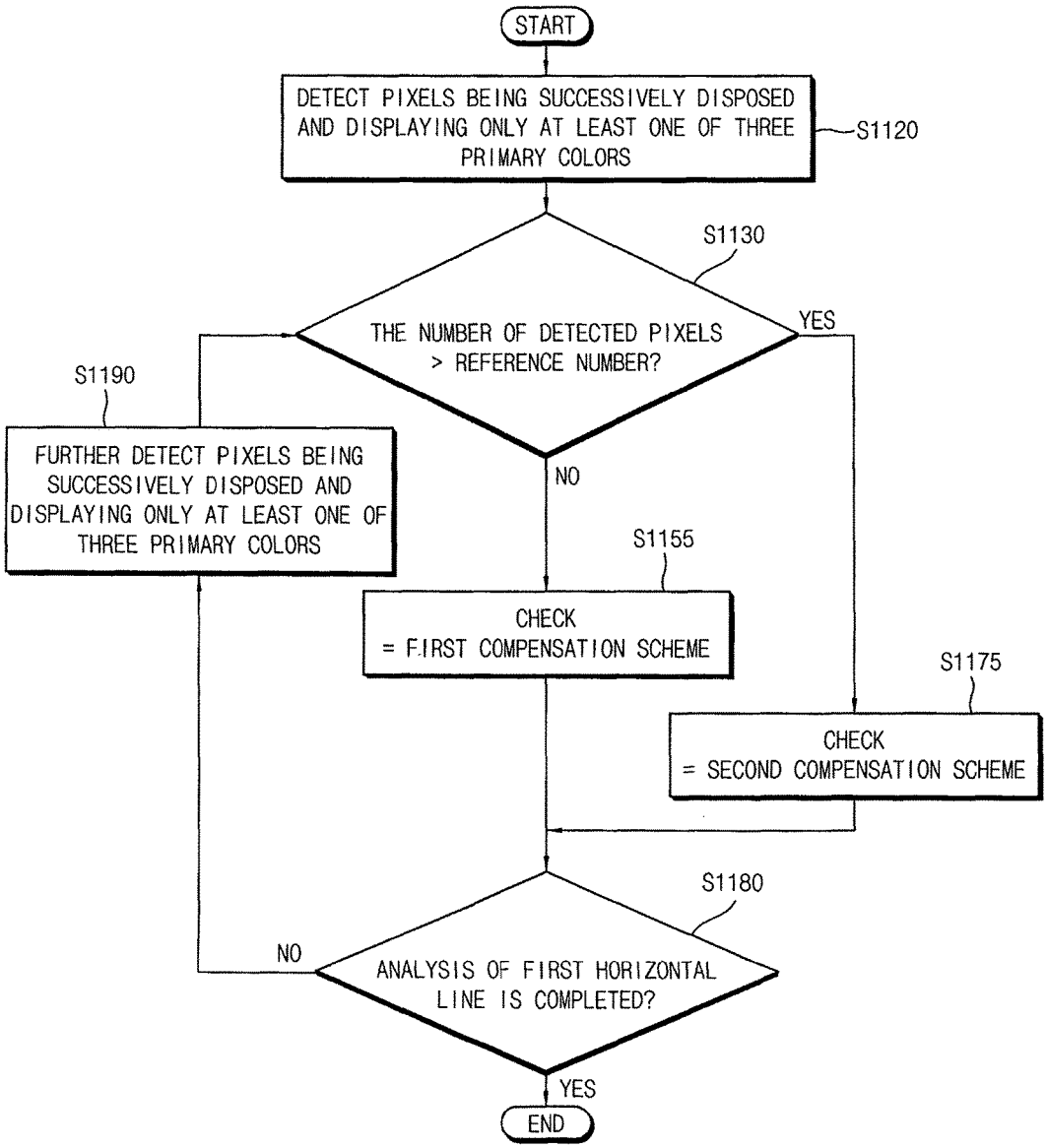

FIGS. 16 and 17 are flow charts illustrating examples of generating a first analyzation result on a plurality of pixel data in FIG. 15 according to an exemplary embodiment of the present inventive concept.

Referring to FIGS. 1, 2, 15, and 16, in the step S1100, a plurality of colors displayed by the plurality of pixels may be determined based on the plurality of pixel data (step S1110). For example, it may be determined whether each of the plurality of colors corresponds to at least one color selected from three primary colors (e.g., red, green, and blue colors) and at least one color selected from three mixed colors (e.g., cyan, magenta, and yellow colors).

When each of the plurality of pixels displays only at least one color selected from the three primary colors or only at least one color selected from the three mixed colors (step S1110: NO), e.g., when each of the plurality of colors corresponds to only the at least one color selected from the three primary colors or only the at least one color selected from the three mixed colors, the first analyzation result may be generated to select the first compensation method, which includes the third decision result on whether the compensation avoidance condition is met, for the compensation on the plurality of pixel data (step S1150).

When each of the plurality of pixels displays both of the at least one color selected from the three primary colors and the at least one color selected from the three mixed colors (step S1110: YES), e.g., when each of the plurality of colors corresponds to both of the at least one color selected from the three primary colors and the at least one color selected from the three mixed colors, the first analyzation result may be generated to select the second compensation method, which does not include the third decision result on whether the compensation avoidance condition is met, for the compensation on the plurality of pixel data (step S1170).

In an exemplary embodiment of the present inventive concept, the steps S1110, S1150, and S1170 in FIG. 16 may be performed by the data compensation unit 210 included in the timing controller 200.

Referring to FIGS. 1, 2, 15, and 17, in the step S1100, the plurality of colors, which are displayed respectively by the plurality of pixels, may be determined based on the plurality of pixel data. N pixels (where N is a natural number equal to or greater than two) among the plurality of pixels may be detected (step S1120). The N pixels may be successively disposed in a first horizontal line and may display only at least one color selected from the three primary colors.

The number of the N pixels may be compared with a reference number (step S1130). It may be determined whether a pattern displayed by the N pixels corresponds to a gamma test pattern or a normal pattern based on the reference number. The reference number may be set by a user.

When N is smaller than or equal to the reference number (step S1130: NO), the first analyzation result may be generated to select the first compensation method for the compensation on N pixel data corresponding to the N pixels (step S1155). For example, when N is smaller than or equal to the reference number, it may be determined that the pattern displayed by the N pixels corresponds to the normal pattern, and the first compensation method may be selected for the normal pattern.

When N is greater than the reference number (step S1130: YES), the first analyzation result may be generated to select the second compensation method for the compensation on the N pixel data corresponding to the N pixels (step S1175). For example, when N is greater than the reference number, it may be determined that the pattern displayed by the N pixels corresponds to the gamma test pattern, and the second compensation method may be selected for the gamma test pattern.

In addition, it may be determined whether the analysis on a plurality of pixels disposed in the first horizontal line is completed (step S1180).

When the analysis on the plurality of pixels disposed in the first horizontal line is not completed (step S1180: NO), e.g., when one of the first compensation method and the second compensation method is not selected for all of the plurality of pixels disposed in the first horizontal line, K pixels (K is a natural number equal to or greater than two) among the plurality of pixels may be further detected (step S1180). The K pixels may be disposed subsequent to the N pixels, may be successively disposed in the first horizontal line, and may display only at least one color selected from the three primary colors. The steps S1130, S1155, S1175, S1180, and S1190 may be repeated for each of the K pixels. The steps S1130, S1155, S1175, S1180, and S1190 may be repeated until the analysis on the plurality of pixels in the first horizontal line is completed.

When the analysis on the plurality of pixels in the first horizontal line is completed (step S1180: YES), e.g., when one of the first compensation method and the second compensation method is selected for the compensation on all of the plurality of pixels in the first horizontal line, the analysis on the plurality of pixels in the first horizontal line may be terminated.

In an exemplary embodiment of the present inventive concept, the steps S1120, S1130, S1155, S1175, S1180, and S1190 in FIG. 17 may be performed by the data compensation unit 210 included in the timing controller 200.

In the method of driving the display panel 100 described above with reference to FIG. 17, defects (e.g., a contour artifact) on the display panel 100 may be reduced even if the gamma test pattern is displayed on a portion of the display panel. Accordingly, display quality of the display panel 100 may be increased.

The above described exemplary embodiments of the present inventive concept may be used in a display panel, a display apparatus or a system including the display apparatus, such as a mobile phone, a smart phone, a personal digital assistant (PDA), a portable media player (PMP), a digital camera, a digital television, a set-top box, a music player, a portable game console, a navigation device, a personal computer (PC), a server computer, a workstation, a tablet computer, a laptop computer, a smart card, a printer, etc.

The foregoing is illustrative of exemplary embodiments of the present inventive concept and the present inventive concept should not to be construed as being limited to the exemplary embodiments disclosed herein. Although a few exemplary embodiments have been described, it will be understood that various modifications in forms and detail may be possible without materially departing from the spirit and scope of the present inventive concept as defined in the appended claims.

What is claimed is:

1. A method of driving a display panel, the method comprising:

generating, by a timing controller, a first decision that includes determining, based on a position of a first pixel in the display panel, whether compensation for first pixel data for the first pixel is required;

generating, by the timing controller, a second decision that includes determining, based on previous subpixel data and present subpixel data for the first pixel, whether the compensation for the first pixel data is required;

generating, by the timing controller, a third decision that includes determining whether the first pixel data complies with a compensation avoidance condition;

compensating the first pixel data when a result of all of the first decision, the second decision, and the third decision indicate that the compensation for the first pixel data is required; and generating a first data voltage based on the compensated first pixel data when the result of all of the first decision, the second decision, and the third decision indicate that the compensation for the first pixel data is required, the first data voltage being applied to the first pixel through a data line, wherein compensating the first pixel data includes the timing controller determining a difference in a grayscale between the present subpixel data and the previous subpixel data stored in a memory, and adding the difference in grayscale to the present subpixel data, wherein the third decision further includes determining a first color displayed through the first pixel based on the first pixel data, wherein determining the first color includes:

comparing the previous subpixel data with first threshold data;

comparing the first subpixel data with the first threshold data; and determining that the first pixel displays one of three primary colors when a value of the previous subpixel data is smaller than a value of the first threshold data and when a value of the first subpixel data is smaller than the value of the first threshold data.

2. The method of claim 1, wherein the third decision is generated to maintain the first pixel data when the first pixel displays one of the three primary colors, and wherein the third decision is generated to compensate the first pixel data when the first pixel displays a color other than the three primary colors.

3. The method of claim 2, wherein the first pixel includes:

a first subpixel configured to operate based on first subpixel data;

a second subpixel configured to operate based on the present subpixel data; and a third subpixel configured to operate based on the previous subpixel data.

4. The method of claim 3, wherein determining the first color further includes:

determining that the first pixel displays the color other than the three primary colors when the value of the previous subpixel data is equal to or greater than the value of the first threshold data or when the value of the first subpixel data is equal to or greater than the value of the first threshold data.

5. The method of claim 1, wherein compensating the first pixel data includes:

adding a value of compensation data to a value of the present subpixel data when the result of all of the first decision, the second decision, and the third decision indicate that the compensation for the first pixel data is required.

6. The method of claim 5, wherein compensating the first pixel data further includes:

determining a second color displayed through a second pixel adjacent to the first pixel after a first color displayed through the first pixel is determined, wherein the first pixel and the second pixel are disposed in a first horizontal line of the display panel;

comparing a first maximum grayscale of the first color displayed by the first pixel with a second maximum grayscale of the second color displayed by the second pixel, wherein the first maximum grayscale is a largest one of first grayscales of the first color, and the second maximum grayscale is a largest one of second grayscales of the second color;

comparing each of grayscales other than the first maximum grayscale among the first grayscales with a reference grayscale;

decreasing the value of the compensation data when the second pixel displays one of three primary colors, and when the first maximum grayscale is substantially the same as the second maximum grayscale, and when each of the grayscales other than the first maximum grayscale among the first grayscales is smaller than the reference grayscale; and maintaining the value of the compensation data when the second pixel displays a color other than the three primary colors, or when the first maximum grayscale is different from the second maximum grayscale, or when each of the grayscales other than the first maximum grayscale among the first grayscales is equal to or greater than the reference grayscale.

7. The method of claim 1, wherein the second decision further includes:

comparing the previous subpixel data with first threshold data; and comparing the present subpixel data with second threshold data, wherein the second decision is generated to compensate the first pixel data when a value of the previous subpixel data is smaller than a value of the first threshold data and when a value of the present subpixel data is greater than a value of the second threshold data, and wherein the second decision is generated to maintain the first pixel data when the value of the previous subpixel data is equal to or greater than the value of the first threshold data or when the value of the present subpixel data is equal to or smaller than the value of the second threshold data.

8. The method of claim 1, wherein the second decision further includes comparing first difference data with first threshold data, the first difference data corresponding to a difference between the present subpixel data and the previous subpixel data, wherein the second decision is generated to compensate the first pixel data when a value of the first difference data is greater than a value of the first threshold data, and wherein the second decision is generated to maintain the first pixel data when the value of the first difference data is equal to or smaller than the value of the first threshold data.

9. The method of claim 1, wherein the second decision further includes:

comparing the previous subpixel data with first threshold data;

comparing the present subpixel data with second threshold data; and comparing first difference data with third threshold data, the first difference data corresponding to a difference between the present subpixel data and the previous subpixel data, wherein the second decision is generated to compensate the first pixel data when a value of the previous subpixel data is smaller than a value of the first threshold data, and when a value of the present subpixel data is greater than a value of the second threshold data, and when a value of the first difference data is greater than a value of the third threshold data, and wherein the second decision is generated to maintain the first pixel data when the value of the previous subpixel data is equal to or greater than the value of the first threshold data, or when the value of the present subpixel data is equal to or smaller than the value of the second threshold data, or when the value of the first difference data is equal to or smaller than the value of the third threshold data.

10. A display apparatus comprising:

a display panel including a first pixel connected to a gate line and a data line;

a gate driver configured to apply a gate signal to the gate line, the gate signal having an active period corresponding to at least two successive horizontal periods;

a data driver configured to generate a first data voltage applied to the data line; and a timing controller configured to control the gate driver and the data driver, to generate a first decision, a second decision, and a third decision, and to compensate first pixel data for the first pixel when a result of all of the first decision, the second decision, and the third decision indicate that compensation for the first pixel data is required, wherein the first decision includes determining, based on a position of the first pixel in the display panel, whether the compensation for the first pixel data is required, wherein the second decision includes determining, based on previous subpixel data and present subpixel data for the first pixel, whether the compensation for the first pixel data is required, wherein the third decision includes determining whether the first pixel data complies with a compensation avoidance condition, wherein the timing controller is configured to compensate the first pixel data based on a difference in grayscale between the present subpixel data and the previous subpixel data stored in a memory, and addition of the difference in grayscale to the present subpixel data as compensation data, wherein data driver is configured to generate the first data voltage based on the compensated first pixel data when the result of all of the first decision, the second decision, and the third decision indicate that the compensation for the first pixel data is required, wherein the first pixel includes:

a first subpixel configured to operate based on first subpixel data;

a second subpixel configured to operate based on the previous subpixel data, and a third subpixel configured to operate based on the previous subpixel data, and wherein the timing controller includes a data compensation unit configured to determine that the first pixel displays one of three primary colors when a value of the previous subpixel data is smaller than a value of first threshold data and when a value of the first subpixel data is smaller than the value of the first threshold data.

11. The display apparatus of claim 10, wherein the data compensation unit is further configured to generate the first decision, the second decision and the third decision, and to compensate the first pixel data when the result of all of the first decision, the second decision, and the third decision indicate that compensation for the first pixel data is required, and the timing controller further includes a control signal generation unit configured to generate a first control signal for the gate driver and a second control signal for the data driver based on an input control signal.

12. The display apparatus of claim 11, wherein the data compensation unit is configured to generate the third decision to maintain the first pixel data when the first pixel displays one of the three primary colors, or to generate the third decision to compensate the first pixel data when the first pixel displays a color other than the three primary colors.

13. The display apparatus of claim 11, wherein the data compensation unit adds a value of compensation data to a value of the present subpixel data when the result of all of the first decision, the second decision and the third decision indicate that the compensation for the first pixel data is required.

14. The display apparatus of claim 13, wherein the data compensation unit changes the compensation data.

15. The display apparatus of claim 14, wherein the data compensation unit reduces the value of the compensation data when a second pixel adjacent to the first pixel displays one of three primary colors, and when a largest first grayscale among first grayscales of a first color displayed through the first pixel is substantially a same value as a largest second grayscale among second grayscales of a second color displayed through the second pixel, and when each of first grayscales other than the largest first grayscale among the first grayscales is smaller than a reference grayscale, wherein the first pixel and the second pixel are disposed in a first horizontal line of the display panel.

16. A method of driving a display panel, the method comprising:

analyzing, by a timing controller, a plurality of pixel data for a plurality of pixels disposed in a first horizontal line of the display panel; and selecting, by the timing controller, one of a first compensation method or a second compensation method, based on a result of the analyzing the plurality of pixel data, for performing compensation of the plurality of pixel data, wherein the first compensation method includes the timing controller;

generating a first decision, based on a position of a first pixel in the display panel, as to whether compensation for first pixel data for the first pixel among the plurality of pixel data is required;

generating a second decision, based on previous subpixel data and present subpixel data for the first pixel, as to whether the compensation for the first pixel data is required;

generating a third decision as to whether the first pixel data complies with a compensation avoidance condition;

compensating the first pixel data when a result of all of the first decision, the second decision and the third decision indicate that the compensation for the first pixel data is required, and wherein the second compensation method includes the timing controller:

generating the first decision and the second decision; and compensating the first pixel data when the result of all of the first decision or the second decision indicate that the compensation for the first pixel data is required, wherein the first compensation method includes the timing controller adding a difference in grayscale to the first pixel data based on a difference in grayscale between the present subpixel data and the previous subpixel data retrieved from a lookup table, and the second compensation method includes the timing controller performing at least one of adaptive color correction using a gamma curve and dynamic capacitance compensation utilizing previous frame image data and present frame image data, and wherein the second decision includes:

comparing the previous subpixel data with first threshold data; and comparing the present subpixel data with second threshold data, wherein the second decision is generated to compensate the first pixel data when a value of the previous subpixel data is smaller than a value of the first threshold data and when a value of the present subpixel data is greater than a value of the second threshold data, and wherein the second decision is generated to maintain the first pixel data when the value of the previous subpixel data is equal to or greater than the value of the first threshold data or when the value of the present subpixel data is equal to or smaller than the value of the second threshold data.

17. The method of claim 16, wherein analyzing the plurality of pixel data includes determining a plurality of colors displayed through the plurality of pixels based on the plurality of pixel data, wherein a result of the analyzing of the plurality of pixel data is generated to select the first compensation method for the compensation on the plurality of pixel data when the plurality of pixels display only at least one color selected from three primary colors or only at least one color selected from three mixed colors including cyan, magenta, and yellow colors, and wherein the result of the analyzing of the plurality of pixel data is generated to select the second compensation method for the compensation on the plurality of pixel data when the plurality of pixels display both of the at least one color selected from the three primary colors and the at least one color selected from the three mixed colors.

18. The method of claim 16, wherein analyzing the plurality of pixel data includes:

determining a plurality of colors displayed through the plurality of pixels based on the plurality of pixel data; and comparing a number of N pixels (where N is a natural number equal to or greater than two) among the plurality of pixels with a reference number, wherein the N pixels are successively disposed in the first horizontal line and the N pixels display only at least one of three primary colors, wherein a result of the analyzing of the plurality of pixel data is generated to select the first compensation method for compensation on N pixel data for the N pixels When the number of the N pixels is smaller than or equal to the reference number, and wherein the result of the analyzing of the plurality of pixel data is generated to select the second compensation method for the compensation on the N pixel data for the N pixels when the number of the N pixels is greater than the reference number.

19. The method of claim 1, further comprising:

maintaining the present subpixel data when a result of at least one of the first decision, the second decision, and the third decision indicates that the compensation for the first pixel data is not required; and generating the first data voltage based on the first pixel data when the result of at least one of the first decision, the second decision, and the third decision indicates that the compensation for the first pixel data is not required.

* * * * *